US007479917B2

(12) United States Patent
Kurihara et al.

(10) Patent No.: US 7,479,917 B2
(45) Date of Patent: Jan. 20, 2009

(54) ELECTROMAGNETIC WAVE ABSORBER, MANUFACTURING METHOD THEREOF AND ELECTROMAGNETIC WAVE ANECHOIC ROOM

(75) Inventors: Hiroshi Kurihara, Tokyo (JP); Toshifumi Saito, Tokyo (JP); Miki Kasabo, Shiga (JP); Toru Sugahara, Shiga (JP); Takashi Tanoue, Shiga (JP); Kazuya Matsumura, Osaka (JP)

(73) Assignees: TDK Corporation, Tokyo (JP); TORAY Industries, Inc., Tokyo (JP)

( * ) Notice: Subject to any disclaimer, the term of this patent is extended or adjusted under 35 U.S.C. 154(b) by 162 days.

(21) Appl. No.: 11/462,078

(22) Filed: Aug. 3, 2006

(65) Prior Publication Data

US 2007/0030194 A1 Feb. 8, 2007

(30) Foreign Application Priority Data

Aug. 5, 2005 (JP) ..... 2005-227717

(51) Int. Cl.
*H01Q 17/00* (2006.01)

(52) U.S. Cl. ..... 342/1; 342/4

(58) Field of Classification Search ..... 181/284, 181/286, 294, 295; 250/250, 252.1, 515.1, 250/517.1, 519.1; 342/1–4; 361/818, 816
See application file for complete search history.

(56) References Cited

U.S. PATENT DOCUMENTS 2,912,687 A * 11/1959 Leonard ..... 342/8
4,426,801 A * 1/1984 Gates ..... 40/610
5,688,348 A * 11/1997 Diaz et al. ..... 156/197
6,061,011 A 5/2000 Yamamoto et al.
6,407,693 B1 6/2002 Murase et al.
6,784,419 B1 * 8/2004 Hayashi et al. ..... 250/250
2006/0066467 A1 3/2006 Kurihara et al.

FOREIGN PATENT DOCUMENTS

| | | | |
|---|---|---|---|
| EP | 1 589 800 A1 | | 10/2005 |
| JP | 02-097096 | | 4/1990 |
| JP | 11-087978 | | 3/1999 |
| JP | 2000-216584 | | 8/2000 |
| JP | 2001-127483 | | 5/2001 |
| JP | 2004-253760 | | 9/2004 |
| JP | 2004253760 | * | 9/2004 |
| JP | 2005-340730 | | 12/2005 |

* cited by examiner

*Primary Examiner*—Thomas H Tarcza
*Assistant Examiner*—Peter M Bythrow
(74) *Attorney, Agent, or Firm*—Leydig, Voit & Mayer, Ltd.

(57) ABSTRACT

An electromagnetic wave absorber has a configuration in which at least three hollow tetrahedrons, each having one open face, are connected to one another so that each surface opposite to a respective open face of the hollow tetrahedrons defines a respective side face of a hollow pyramid. Preferably, the electromagnetic wave absorber is made of sheet electromagnetic wave absorption members, which have a corrugated board structure in which at least one sheet includes an electrically conductive material. The electromagnetic wave absorber is low-cost, has reduced transport volume, excellent electromagnetic wave absorption characteristics from low frequency to high frequency with a shorter absorber length, has no or small difference in characteristics due to polarization plane, is lightweight and high in structural strength, and easy to manufacture and install.

25 Claims, 20 Drawing Sheets

ELECTROMAGNETIC WAVE ABSORBER, MANUFACTURING METHOD THEREOF AND ELECTROMAGNETIC WAVE ANECHOIC ROOM

BACKGROUND OF THE INVENTION

1. Field of the Invention

The present invention relates to an electromagnetic wave absorber that is preferably used for an electromagnetic wave anechoic room or the like and a method of manufacturing the electromagnetic wave absorber, and to an electromagnetic wave anechoic room.

2. Description of the Prior Art

An electromagnetic wave anechoic room for EMC (Electromagnetic Compatibility) has been widely put into practical use as an examination site for measuring electromagnetic wave noise radiated from various types of electronic equipment and evaluating tolerance of electronic equipment interfered by external electromagnetic wave noise. Also, in recent years, there is a movement that the electromagnetic wave anechoic room is used for a place (CALTS=Calibration Test Site) to calibrating an antenna for radiation noise measurement.

Electromagnetic wave absorbers are installed on a ceiling and walls of an electromagnetic wave anechoic room for EMC to thereby provide a space where electromagnetic wave reflections from any positions other than a floor surface (metal surface) can be minimized. As the electromagnetic wave absorber to be used on the ceiling and walls of the electromagnetic wave anechoic room for EMC, a complex type electromagnetic wave absorber is currently employed in many cases. The complex type electromagnetic wave absorber is, as shown in FIG. 20, a combination of a sintered ferrite compact 1 as an electromagnetic wave absorption member consisting of magnetic loss material and an electromagnetic wave absorber 2 containing electrically conductive material.

As the electromagnetic absorber containing electrically conductive material, an absorber having a pyramid or wedge shape has conventionally been often employed, wherein a base material (a dielectric material having a low dielectric constant) such as foamed polystyrol or foamed polyurethane is used to retain electrically conductive material such as carbon or graphite. The length of the electromagnetic wave absorber is generally approximately 0.5 to 2 m, and a larger and higher-performance electromagnetic wave anechoic room requires a longer absorber. For this reason, problems exist that the electromagnetic wave absorber becomes voluminous, thus causing the increases in transportation and installation costs.

In consideration of the above problems, an electromagnetic absorber has been proposed in order to reduce the cost by reduction of materials necessary, transport volume, weight, and difficulty in installation, wherein the above-described electromagnetic wave absorber is modified to have a hollow structure consisted of sheet-type electromagnetic wave absorption members containing electrically conductive material, thus enabling it to be transported in such a sheet-type condition and then assembled on a site.

Such a hollow-structured electromagnetic wave absorber includes the hollow pyramid type shown in FIGS. 21A and 21B, or the hollow wedge type shown in FIGS. 22A and 22B, or FIGS. 23A and 23B. In FIGS. 21A, 21B, 22A, 22B and 23A, 23B the reference numeral 1 represents a sintered ferrite compact, and 2 a hollow electromagnetic wave absorber that contains electrically conductive material and is arranged in front of the sintered ferrite compacts. The hollow wedge type shown in FIGS. 23A and 23B has an open face on the side (triangular face).

Japanese Patent Application Laid-Open Nos. 11-87978 and 2000-216584 describe examples of publicly known technologies for a hollow electromagnetic wave absorber containing electrically conductive material.

Also, as described in Japanese Patent Laid-Open Nos. 2-97096 and 2001-127483, a rectangular pipe-shaped electromagnetic wave absorber and an electromagnetic wave absorber in which the electromagnetic wave absorbing plates are crisscrossed have also been disclosed.

Meanwhile, the wedge type electromagnetic wave absorber is anisotropic for a polarization plane of an incoming electromagnetic wave and therefore exhibits different characteristics depending on the polarization plane of the incoming electromagnetic wave. In particular, in the case of the hollow wedge type comprised of sheet-type electromagnetic absorption members, there is the problem that the difference in the characteristics caused by the polarization plane is significantly large and high-frequency characteristics are extremely poor when the ridge of the wedge is perpendicular to the polarization plane of the electromagnetic wave. In order to solve this problem of difference in the characteristics caused by the polarization plane, there is a method in which the neighboring absorbers are arranged in such a way that the ridges of wedges become orthogonal to each other when installed on wall surfaces, thereby averaging out the characteristics in the case where the ridge of the wedge is parallel to the polarization plane and in the case where the ridge is perpendicular to the plane. However, with high frequencies, the characteristics in one of the cases (the case where the ridge of the wedge is perpendicular to the polarization plane of the electromagnetic wave) are extremely poor, and therefore the average characteristics also become poor. Furthermore, in the case where the absorbers are arranged on sidewall surfaces as described above, the electromagnetic absorbers arranged in such a way that ridges of the wedges of them are horizontal are half of the total in number, and in such an arrangement, if the length is increased, a problem arises in terms of strength, such as bending. These problems are more significant, particularly in the case of the side face opening type shown in FIGS. 23A and 23B that is more advantageous in cost, productivity, and installation.

On the other hand, the hollow pyramid type is often used since it has no difference in characteristics caused by a polarization plane and is also robust in terms of strength; however, it has poor low frequency characteristics in a range of 30 to 100 MHz in comparison with the hollow wedge type, whereby there is a problem that a length of the absorber should be increased.

In consideration of this problem, a configuration provided with an opening at a tip of a hollow cone-shaped body has been proposed in Japanese Patent Application Laid-Open No. 2005-340730 by the present assignee as an electromagnetic wave absorber having no difference in characteristics caused by the polarization plane and good low frequency characteristics in the 30 to 100 MHz range.

However, there is a problem in the electromagnetic wave absorber having the configuration provided with an opening at a tip of a hollow cone-shaped body disclosed in Japanese Patent Application Laid-Open No. 2005-340730. The problem is that although an electromagnetic wave can reach sintered ferrite compacts through the opening at higher frequencies, an absorption capability of the sintered ferrite compact is low at a high frequency of 1 GHz or higher, and so reflection becomes large. Therefore, an additional electromagnetic wave absorber needs to be added on the bottom in order to improve high frequency characteristics, so that the advantage of being configured in sheet-type cannot be sufficiently utilized.

Similarly, the rectangular pipe-shaped electromagnetic wave absorber disclosed in Japanese Patent Application Laid-Open No. 2-97096 and the electromagnetic wave absorber in which electromagnetic wave absorbing plates are crisscrossed disclosed in Japanese Patent Application Laid-Open No. 2001-127483 have also a problem of poor high frequency characteristics because of the exposure of a sintered ferrite compact. In order to improve the high frequency characteristics, the opening of the rectangular pipe-shaped should be narrowed or a small electromagnetic wave absorber needs to be added on the bottom of the crisscrossed electromagnetic wave absorbing plates, so that the advantage of being configured in sheet-type cannot be sufficiently utilized in either case as well.

SUMMARY OF THE INVENTION

The present invention is in view of such problems, and it is therefore an object of the present invention to provide an electromagnetic wave absorber that is low-cost allows for reduced transport volume, enables excellent electromagnetic wave absorption characteristics to be obtained from low frequency to high frequency with the shorter absorber length, has no or small difference in characteristics caused by a polarization plane, is lightweight and easy in terms of manufacturing and installation, and also to provide a manufacturing method thereof.

Another object of the present invention is to provide an electromagnetic anechoic room employing the above mentioned electromagnetic wave absorber so that it makes the room low-cost, easy in construction, and excellent in electromagnetic wave absorption characteristics.

Other object and new features of the present invention will be clarified in the embodiment section to be described later.

In at least one embodiment of the present invention, an electromagnetic wave absorber comprises a configuration in which three or more hollow tetrahedrons having one open face are connected to one another in such a way that each surface opposite to each open face of the hollow tetrahedrons defines each side face of a hollow pyramid.

Another aspect of the invention provides an electromagnetic wave absorber comprising a configuration in which three or more hollow tetrahedrons having one open face are connected to one another in such a way that each open face of the hollow tetrahedrons defines each side face of a hollow pyramid.

Another aspect of the invention provides a method for manufacturing an electromagnetic wave absorber, comprising: folding two places of each sheet-type electromagnetic wave absorption member to thereby fabricate three or more hollow tetrahedrons having one open face; and connecting the hollow tetrahedrons to one another in such a way that each surface opposite to each open face of the hollow tetrahedrons defines each side face of a hollow pyramid.

Another aspect of the invention provides a method for manufacturing an electromagnetic wave absorber which comprises a configuration wherein three or more hollow tetrahedrons having one open face are connected to one another in such a way that each triangular surface opposite to each open face of the hollow tetrahedrons defines each side face of a hollow pyramid, the method comprising: employing a first sheet-type electromagnetic wave absorption member including a first region to be a triangular surface opposite to the open face of a first hollow tetrahedron, and a second region to be an inverted triangular surface rising with respect to a triangular surface opposite to the open face of a second hollow tetrahedron that is adjacent to the first hollow tetrahedron, and a second sheet-type electromagnetic wave absorption member including an inverted triangular surface rising with respect to the triangular surface opposite to the open face of the first hollow tetrahedron; and connecting three or more members in each of which the second sheet-type electromagnetic wave absorption member is connected to a boundary position between the first and second regions of the first sheet-type electromagnetic wave absorption member.

Another aspect of the invention provides a method for manufacturing an electromagnetic wave absorber, comprising: folding two places of each sheet-type electromagnetic wave absorption member to thereby fabricate three or more hollow tetrahedrons having one open face; and connecting the hollow tetrahedrons to one another in such a way that each open face of the hollow tetrahedrons defines each side face of a hollow pyramid.

Another aspect of the invention provides an electromagnetic wave anechoic room wherein the electromagnetic wave absorbers are disposed on at least one of inner surfaces of sidewalls and a ceiling plane.

Another aspect of the invention provides a sheet-type electromagnetic wave absorption member comprising a shape which is able to fabricate a hollow tetrahedron having one open face in case of folding along boundary lines of a region to be a triangular surface.

Another aspect of the invention provides an electromagnetic wave absorption member comprises a hollow tetrahedron having one open face.

These and other features and advantage of the present invention will be appreciated from reviewing of the following detailed description of the invention, along with the accompanying figures.

DETAILED DESCRIPTION OF THE INVENTION

Figure 1:
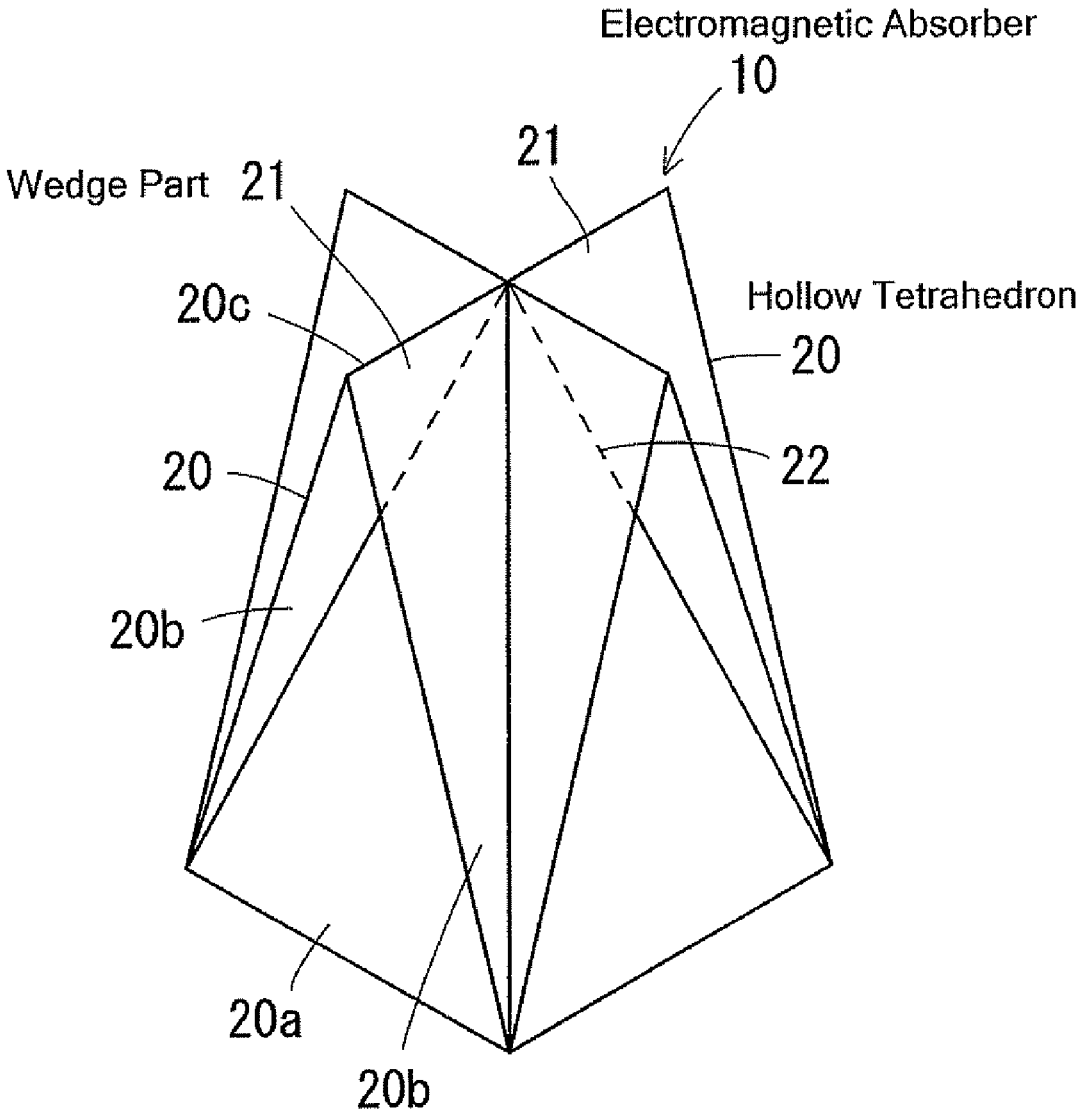
FIG. 1 shows a first embodiment of the present invention and is a perspective view illustrating an electromagnetic wave absorber.
Figure 2A:
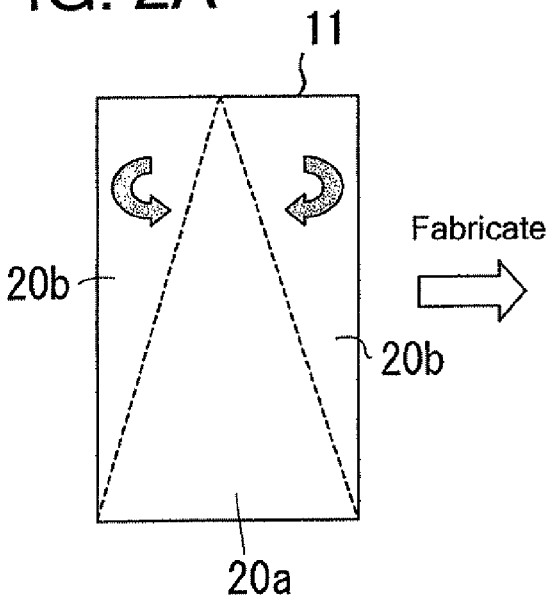
FIGS. 2A, 2B, 2C are explanatory diagrams illustrating a structure and a manufacturing method of the electromagnetic wave absorber shown in the first embodiment.
Figure 2B:
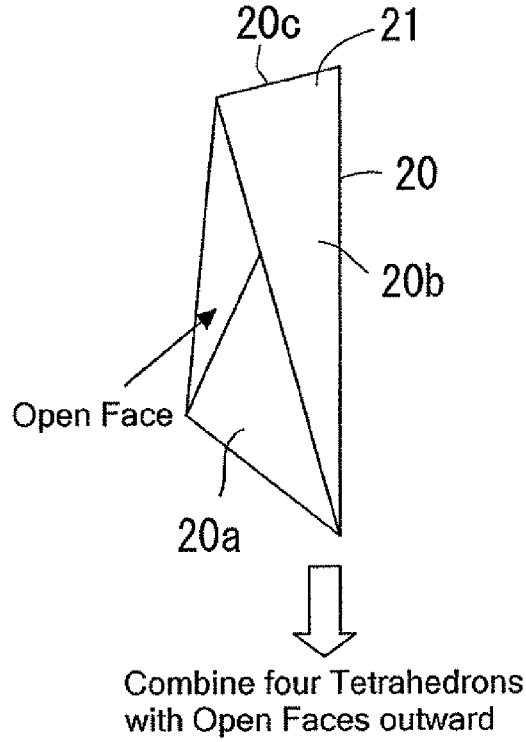
Figure 2C:
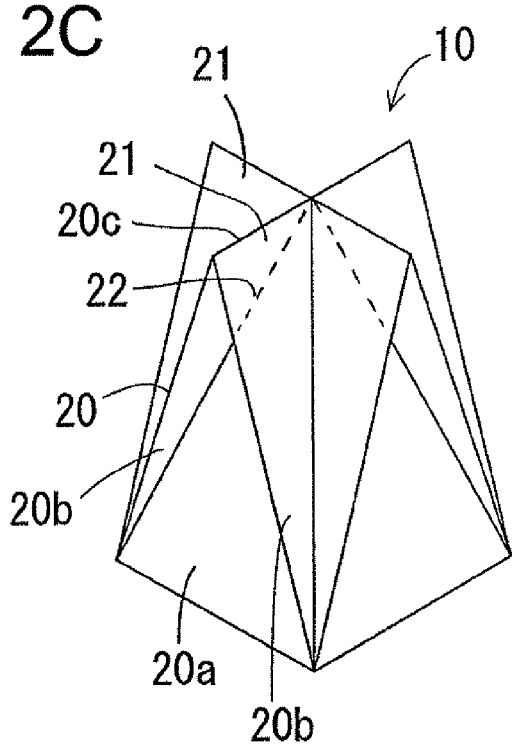

A first embodiment of an electromagnetic wave absorber and the manufacturing method thereof according to the present invention will be described in reference to FIGS. 1 to 12. FIG. 1 shows the appearance of the electromagnetic absorber 10, which has the configuration shown in FIG. 2C, which is fabricated by folding two places of each quadrangular (including rectangular) sheet-type electromagnetic wave absorption member 11 as shown in FIG. 2 A to fabricate four hollow tetrahedrons 20 having one open face as shown in FIG. 2B and then by connecting and integrating the four hollow tetrahedrons 20 with one another in such a way that each triangular surface 20*a* opposite to each open face of the hollow tetrahedrons 20 defines each side face of a hollow quadrangular pyramid 22. If the triangular surface 20*a* has an isosceles triangle shape, the hollow quadrangular pyramid will have a regular quadrangular pyramid shape. Inverted triangular surfaces 20*b* that are folded and rise with respect to the triangular surface 20*a* of the hollow tetrahedron 20 are butted to each other and joined at one edge 20*c* to thereby form a wedge part 21. Accordingly, in the state where the four hollow tetrahedrons 20 are combined as shown in FIG. 1 and FIG. 2C, four wedge parts 21 are formed along the outer corners (ridge lines) of the hollow quadrangular pyramid.

Figure 3:
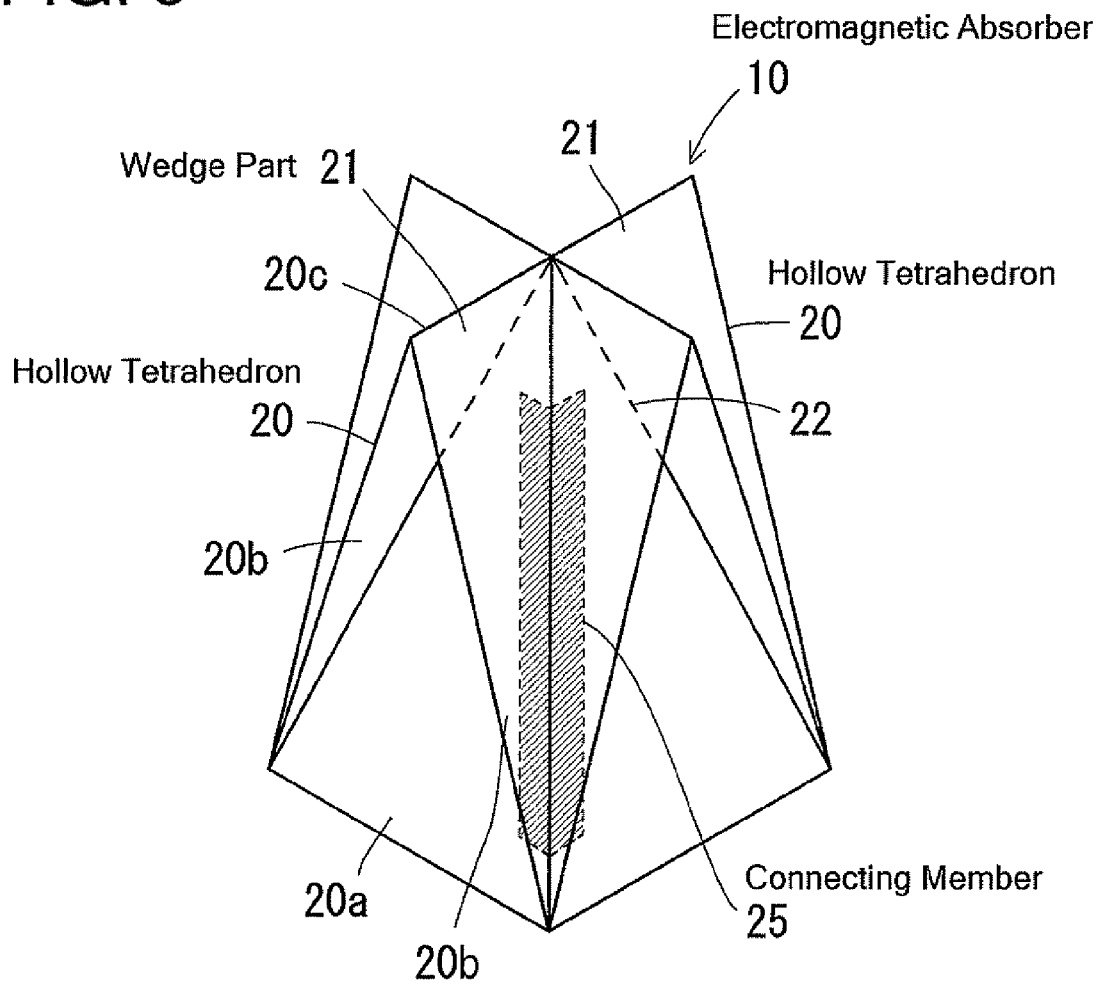
FIG. 3 is a perspective view illustrating one example of the manufacturing method of the electromagnetic wave absorber shown in the first embodiment.
Figure 4A:
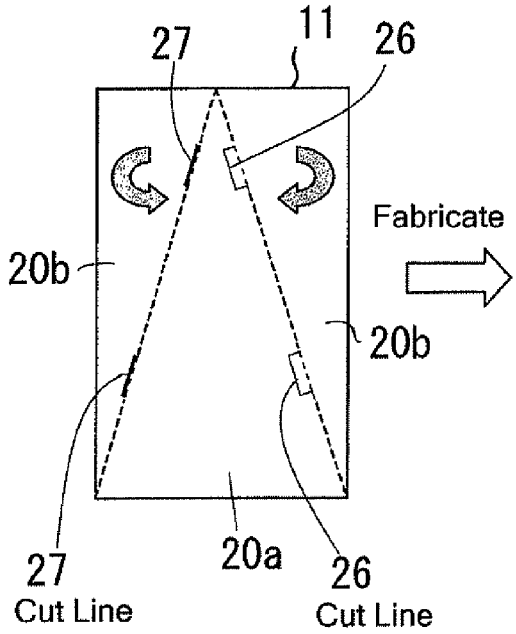
FIGS. 4A, 4B, 4C are explanatory diagrams illustrating another example of the manufacturing method of the electromagnetic wave absorber shown in the first embodiment.
Figure 4B:
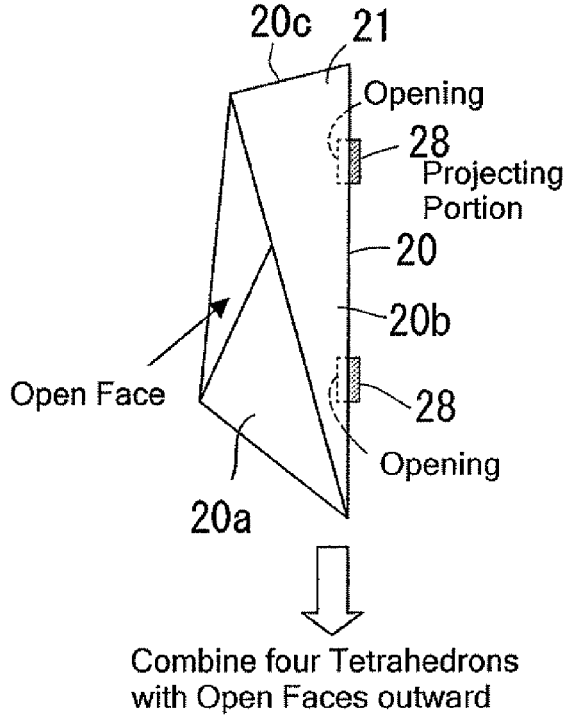
Figure 4C:
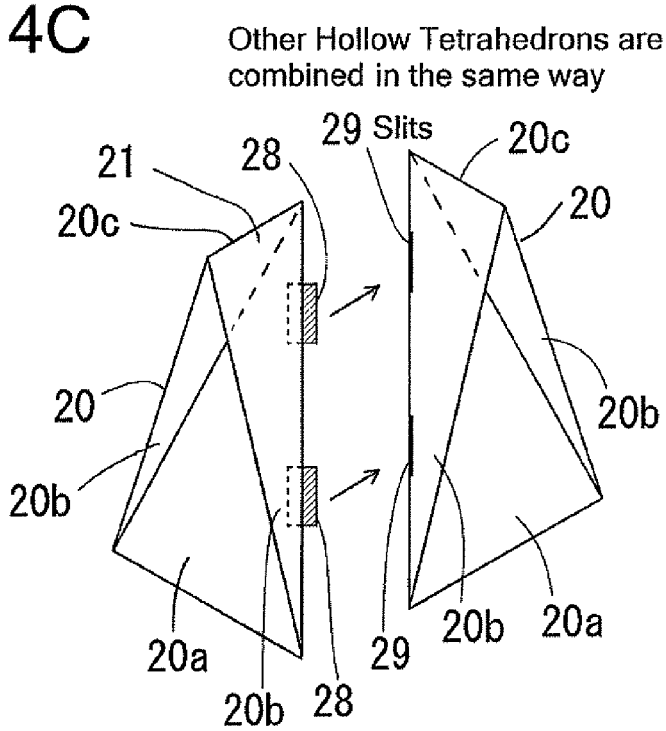

Considering a method for manufacturing the electromagnetic wave absorber shown in FIG. 1, a procedure in which the four hollow tetrahedrons 20 are first fabricated, then combined in such a way that the open faces of them face outward, and connected to and integrated with one another is most comprehensible; however, since the lines along which the two places are folded as shown in FIG. 2 A are used as the connection, it is not easy to provide adhesion margins (overlap widths). In consideration of this, there is a method in which a connecting member 25 for connecting the neighboring hollow tetrahedrons 20 to each other is used as shown in FIG. 3. Alternatively, there is a method in which cut lines 26 and 27 are provided in parts of the electromagnetic wave absorption member 11 as shown in FIG. 4 A, then projecting portions 28 and slits 29 are formed at the same time when each hollow tetrahedron 20 is fabricated by folding as shown in FIGS. 4 B and 4C, the projecting portions 28 of one hollow tetrahedron 20 are inserted into the slits 29 of another hollow tetrahedron 20, and the portions (inserted projecting portions) are used as adhesion margins (overlap widths). In addition, in FIGS. 3 and 4, the same or corresponding parts that are already shown in FIG. 2 is represented by the same number.

Figure 5:
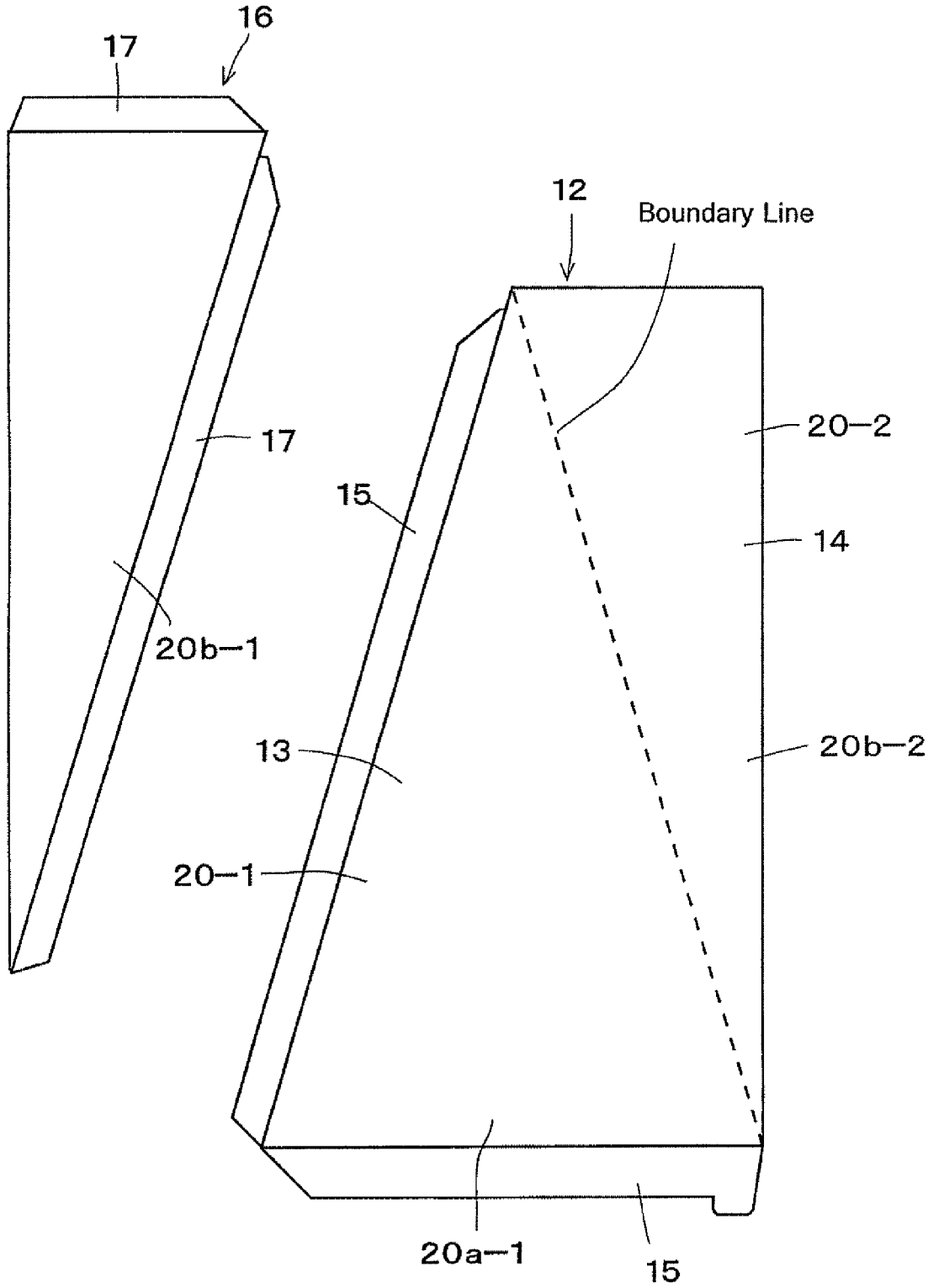
FIG. 5 is a plan view illustrating a shape of a sheet-type electromagnetic wave absorption member used for another example of the manufacturing method of the electromagnetic wave absorber shown in the first embodiment.
Figure 6:
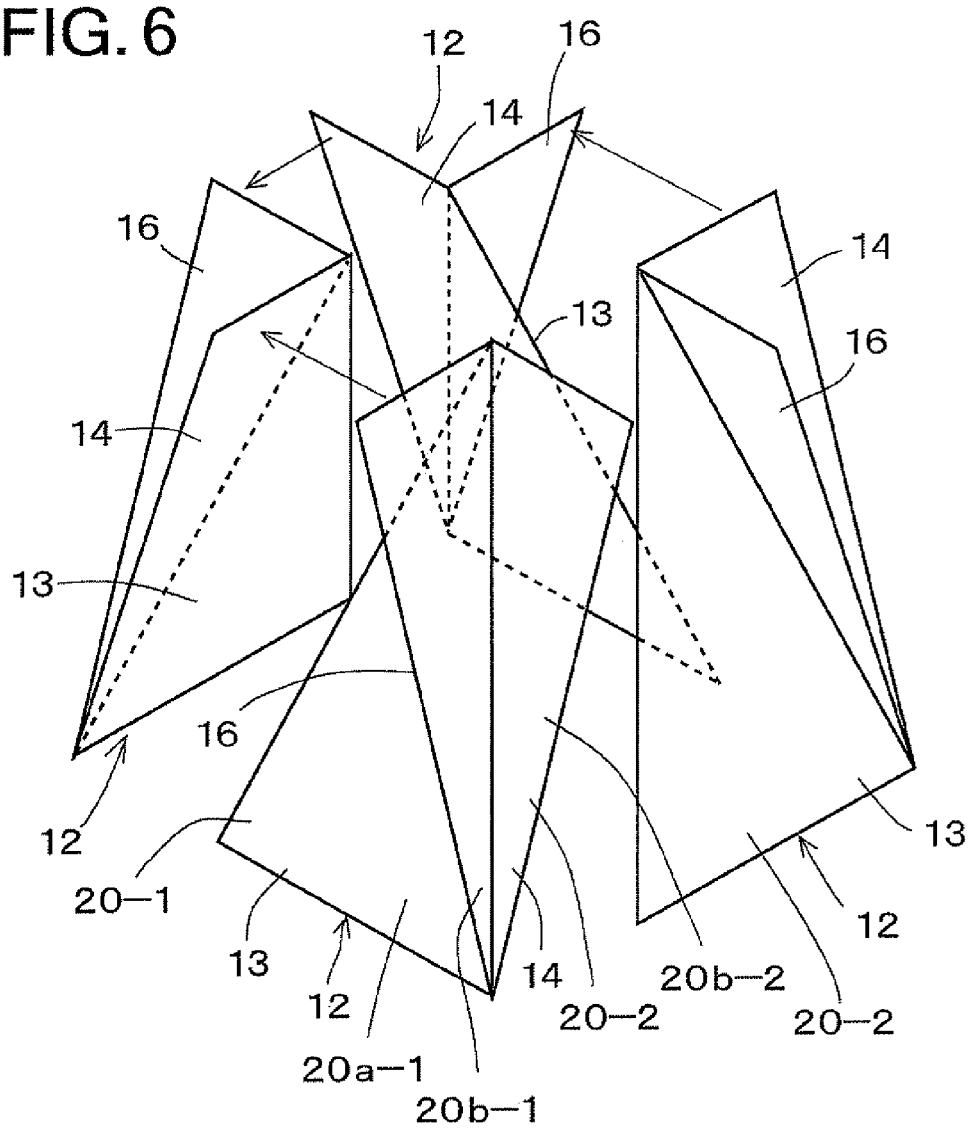
FIG. 6 is an exploded perspective view illustrating the manufacturing method using the sheet-type electromagnetic wave absorption member shown in FIG. 5.

Moreover, since it is only necessary to form a structure in which the four hollow tetrahedrons 20 are connected to and integrated with one another in its completed condition, the manufacturing method shown in FIGS. 5 and 6 can also be used. In this case, a first sheet-type electromagnetic absorption member 12 and a second sheet-type electromagnetic wave absorption member 16 are used. The first sheet-type electromagnetic absorption member 12 is comprised of a first region 13 to be a triangular surface 20*a*-1 opposite to an open face of a first hollow tetrahedron 20-1, a second region 14 to be an inverted triangular surface 20*b*-2 rising with respect to a triangular surface opposite to an open face of a second hollow tetrahedron 20-2 adjacent to the first hollow tetrahedron 20-1, and an adhesion margin (overlap width) 15 for connection. The second sheet-type electromagnetic wave absorption member 16 is comprised of an inverted triangular surface 20*b*-1 rising with respect to the triangular surface 20*a*-1 opposite to the open face of the first hollow tetrahedron 20-1 and an adhesion margin (overlap width) 17 for connection is used.

Then, as shown in FIG. 6, four members in each of which the second sheet-type electromagnetic wave absorption member 16 is connected to a boundary position between the first region 13 and second region 14 of the first sheet-type electromagnetic wave absorption member 12 are fabricated, and connecting and integrating the four members to and with one another enable the electromagnetic wave absorber 10 in its completed condition, as shown in FIG. 1 to be obtained. The connection between the respective sheet-type electromagnetic wave absorption members 12 and 16 can be made by the application of an adhesive onto the adhesion margins 15 and 17, by the attachment of double-sided adhesive tape, by fastening with plastic screws or the like.

In the manufacturing method shown in FIGS. 5 and 6, the adhesion margins (overlap widths) are provided at the connection portions and in addition even a part of the neighboring hollow tetrahedrons 20 are comprised of the sheet-type electromagnetic wave absorption members 12. Therefore, the method has an advantage of increasing the strength of the electromagnetic wave absorber when it is assembled as shown in FIG. 1

Figure 7:
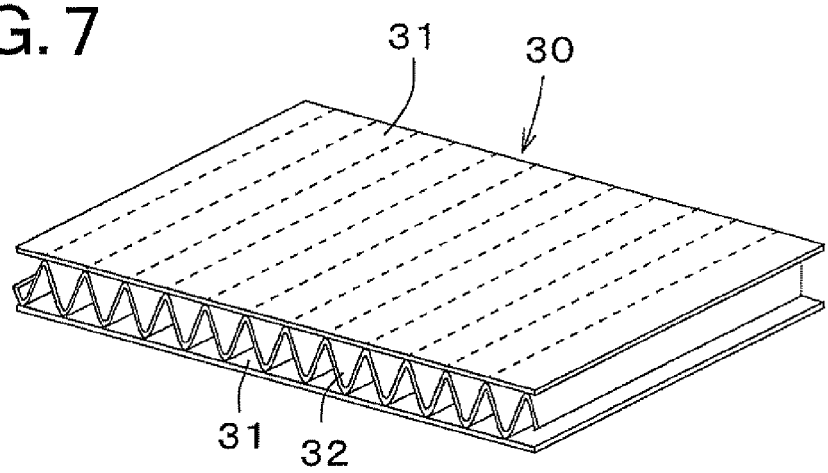
FIG. 7 is a perspective view illustrating an electromagnetic wave absorption member with a corrugated board structure that may be used for the electromagnetic wave absorber shown in the first embodiment.
Figure 8A:
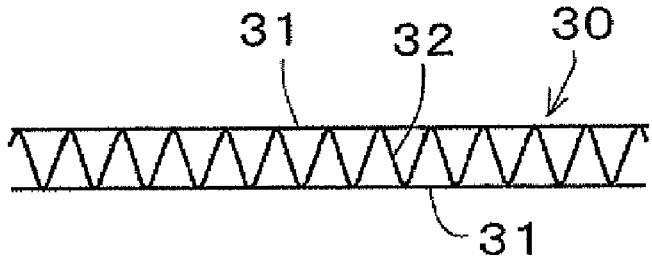
FIGS. 8A, 8B, 8C, 8D are cross-sectional views illustrating electromagnetic wave absorption members with a corrugated board structure that may be used for the electromagnetic wave absorber shown in the first embodiment.

As the sheet-type electromagnetic wave absorption member that may be used in the first embodiment described above, electromagnetic wave absorption members with a corrugated board structure are shown in FIGS. 7 and FIGS. 8A, 8B, 8C and 8D (described in Japanese Patent Application Laid-Open No. 2004-253760). FIG. 7 and FIG. 8A show the electromagnetic wave absorption member with a double-faced corrugated board structure 30, which is configured by stacking and integrating flat sheet liners 31 and a core sheet 32 that is a corrugated (bent in a wave pattern) sheet, in such a way that the core sheet 32 is placed between the flat sheet liners 31. Top and valley portions of the core sheet 32 bent in a wave pattern are bonded to upper and lower liners 31 respectively with an adhesive. At least one of liner sheets 31 and core sheet 32 contains electrically conductive material. For example, in one or both of liners 31 and core sheet 32, a sheet containing electrically conductive material (such as carbon, graphite, or electrically conductive fibers), or preferably carbon fiber mixed paper or the like may be used. As the base material of the mixed paper or the like comprising the corrugated board, flame-resistant or nonflammable material may be used.

Figure 8B:
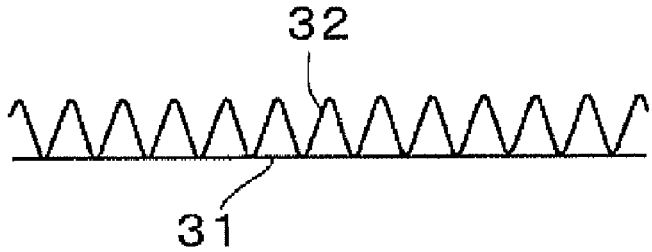
Figure 8C:
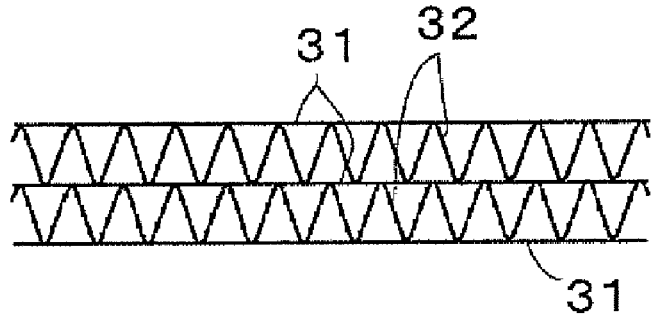
Figure 8D:
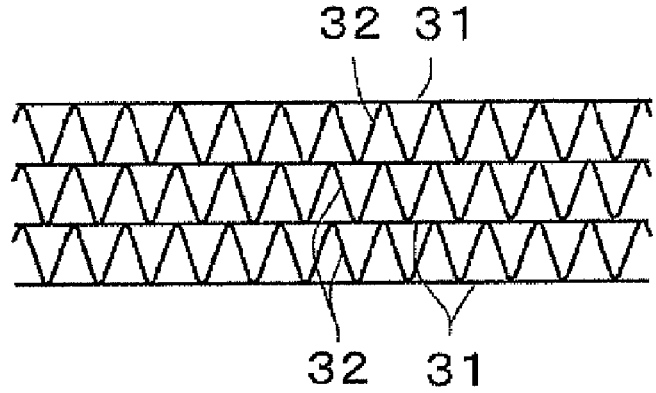

Besides the electromagnetic wave absorber with the double-faced corrugated board structure, an electromagnetic wave absorption member with a single-faced corrugated board structure shown in FIG. 8B in which a corrugated core sheet 32 is attached to a single liner 31, an electromagnetic wave absorption member with a composite double-faced corrugated board structure shown in FIG. 8C in which a single-faced corrugated board is bonded to a double-faced corrugated board, or an electromagnetic wave absorption member with a triple-wall structure shown in FIG. 8D in which a single-faced corrugated board is bonded to a composite double-faced corrugated board to form three layers may be used as a sheet-type electromagnetic wave absorption member.

Each of the sheet-type electromagnetic wave absorption members shown in the above FIGS. 7 and 8A to 8D is lightweight because of its hollow structure, and comprises appropriate rigidity since the corrugated core sheet 32 is internally placed, whereby even after it has been assembled into the electromagnetic wave absorber, a good shape retention property can be maintained. Also, it can be stored and transported in a flat sheet condition, so that it is not bulky and can be transported at low cost.

Figure 9B:
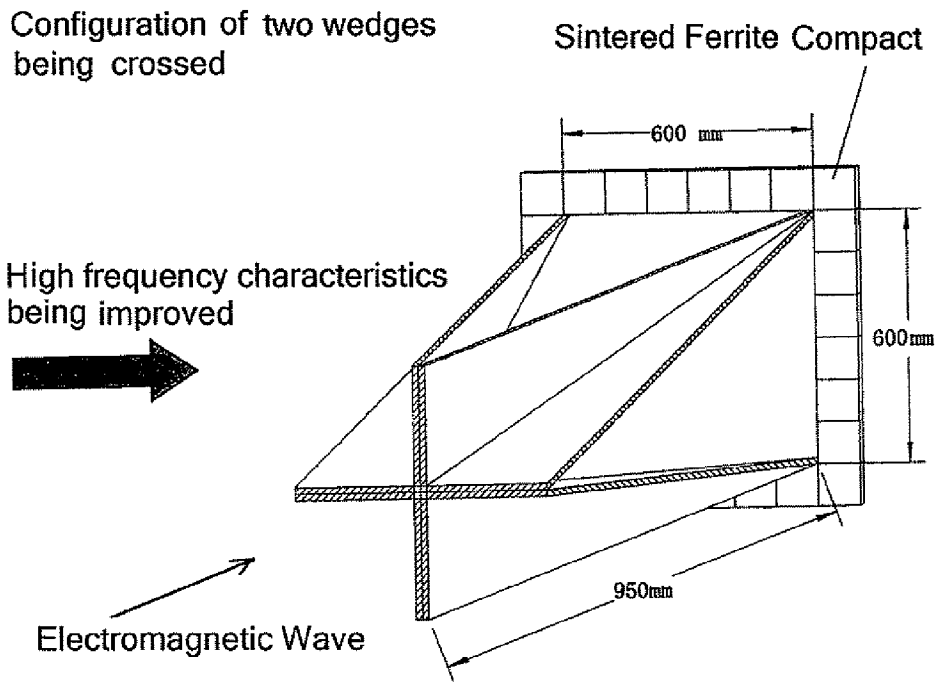
FIG. 9A is a perspective view of a measurement sample of an electromagnetic wave absorber in the case where a rectangular pipe-shaped electromagnetic wave absorber is arranged in front of sintered ferrite compacts, and FIG. 9B a perspective view illustrating the case where an electromagnetic wave absorber having a configuration shown in the first embodiment in which wedges are crossed is arranged in front of sintered ferrite compacts.
Figure 9A:
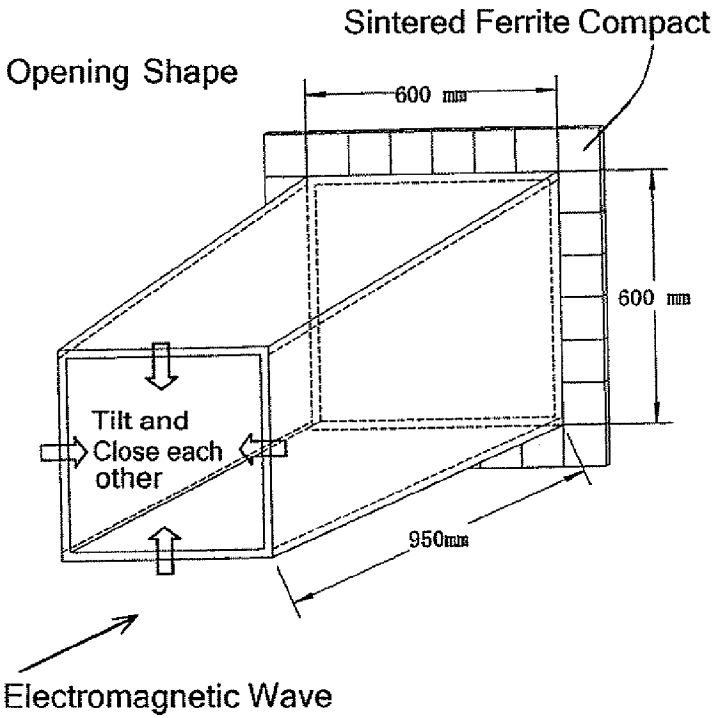

FIG. 9A shows a shape of an opening of a rectangular pipe-shaped electromagnetic wave absorber placed in front of sintered ferrite compacts, and when the opening is changed in the closing direction by tilting surfaces of the rectangular pipe in such a way that the opposed surfaces are brought close to each other, and furthermore changed into the configuration of the electromagnetic wave absorber in the first embodiment according to the present invention as shown in FIG. 9B (a configuration in which two wedges are crossed), high frequency characteristics in electromagnetic wave absorption characteristics are improved. This is described below.

Figure 10:
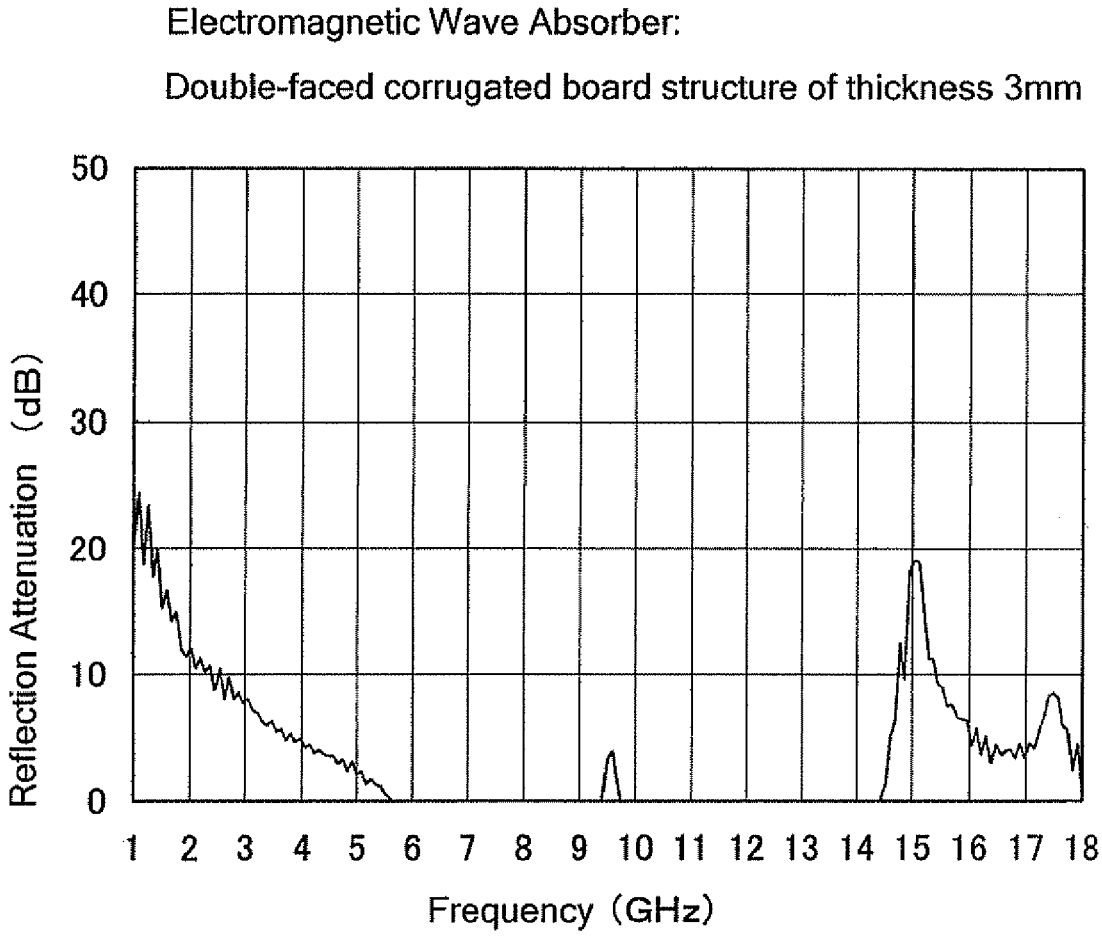
FIG. 10 shows a graph of reflection attenuation versus frequency in the case of FIG. 9A where the electromagnetic wave absorber arranged in front of the sintered ferrite compacts is in a rectangular pipe shape.

FIG. 10 shows a graph of reflection attenuation (dB) versus frequency (GHz) characteristics in the case where the electromagnetic wave absorber placed in front of the sintered ferrite compacts shown in FIG. 9A is in the shape of the rectangular pipe, and exhibits poor electromagnetic wave absorption characteristics in the higher frequency range than 1 GHz.

Figure 11:
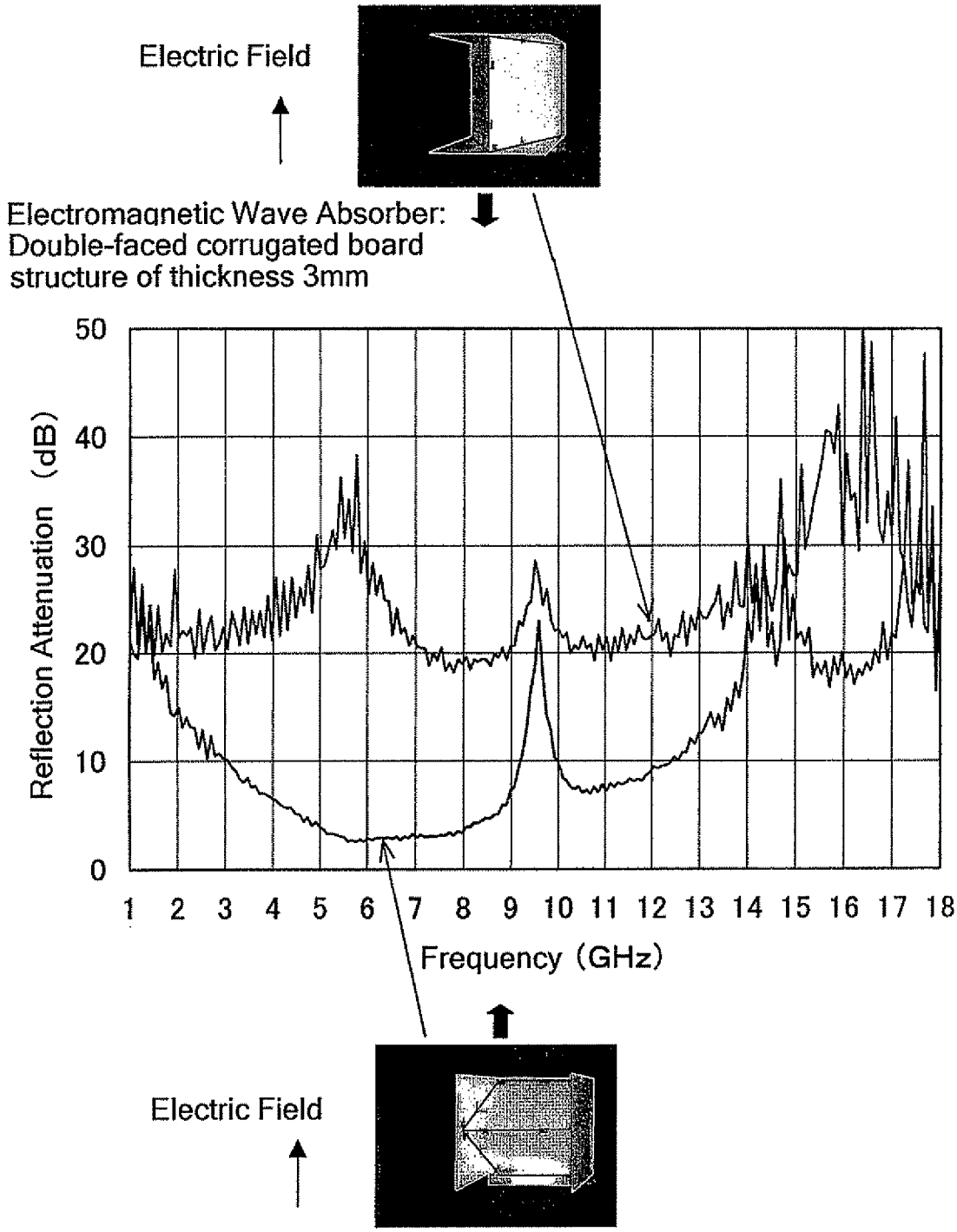
FIG. 11 shows a graph of reflection attenuation versus frequency in each case where the ridge of a wedge is perpendicular or parallel to an electric field when the wedge is formed by joining a pair of edges of opposed surfaces of a rectangular pipe-shaped electromagnetic wave absorber.

FIG. 11 shows a graph of reflection attenuation (dB) versus frequency (GHz) characteristics in each case where the ridge of a wedge is perpendicular or parallel to the electric field of an incoming electromagnetic wave when the wedge is formed by closing a pair of edges of opposed surfaces (electromagnetic wave absorption members) of the rectangular pipe. In the case where one pair of edges of surfaces is closed to form one wedge, it has turned out that the high frequency characteristics are significantly improved if the ridge of the wedge is parallel to the electric field. However, if the ridge of the wedge is perpendicular to the electric field, such improvement effect is small.

Figure 12:
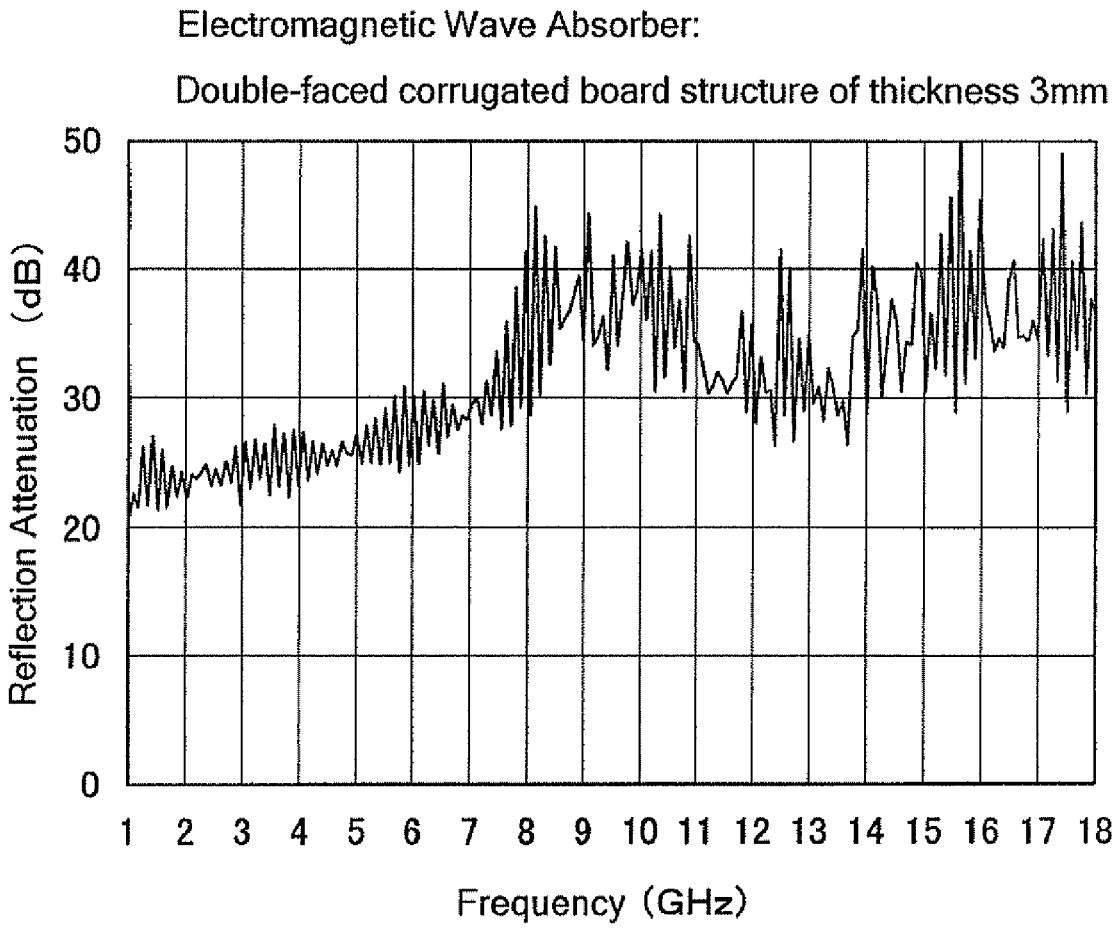
FIG. 12 shows a graph of reflection attenuation versus frequency in the case of a configuration in which two wedges are crossed, i.e., the configuration in the first embodiment of the present invention.

Hence, a configuration in which two sets (pairs) of edges of opposed surfaces respectively present in two directions are closed to thereby form two wedges so as to be effective for such two polarized waves, i.e., the configuration of the electromagnetic wave absorber shown in FIG. 9B (the configuration in which two wedges are crossed) according to the present invention has been made. Reflection attenuation (dB) versus frequency (GHz) characteristics in such a case is shown in FIG. 12. In comparison with the case shown in FIG. 10 or FIG. 11, the high frequency characteristics particularly in the higher frequency range than 1 GHz are significantly improved. Also, it turns out that due to the symmetrical property of the configuration, there is no difference in characteristics caused by a polarization plane.

According to the first embodiment following effects are obtained.

(1) The electromagnetic wave absorber 10 has a configuration in which four hollow tetrahedrons 20 having one open face are connected to one another, can be formed by folding sheet-type electromagnetic wave absorption members, and enables transport volume to be reduced by being transported in sheet-type electromagnetic wave absorption members. Furthermore, using low-cost and sheet-type electromagnetic wave absorption members 30 with a corrugated board structure can reduce the weight of the electromagnetic wave absorber 10 and increase the structural strength thereof, thus facilitating manufacturing it and installing it to an electromagnetic wave anechoic room or the like.

(2) Folding sheet-type electromagnetic wave absorption members and connecting them with double-sided adhesive tape, an adhesive, or the like enable the electromagnetic wave absorber 10 to be assembled. Special tools or parts are not required for the assembling, thus facilitating installing it to an electromagnetic wave anechoic room or the like.

(3) The exterior configuration of the electromagnetic wave absorber 10 corresponds to that provided by crossing two wedges, and can obtain excellent electromagnetic wave absorption characteristics from low frequency to high frequency in comparison with a pyramidal type, and since the two wedges are provided by being mutually orthogonalized, there is no difference in characteristics caused by a polarization plane.

(4) Configuring a complex electromagnetic absorber structure in which sintered ferrite compacts are arranged on the bottom face of the hollow quadrangular pyramid 22 in the electromagnetic wave absorber 10 as shown in FIG. 9B enables electromagnetic wave absorption characteristics in a low frequency range to be improved.

Figure 13:
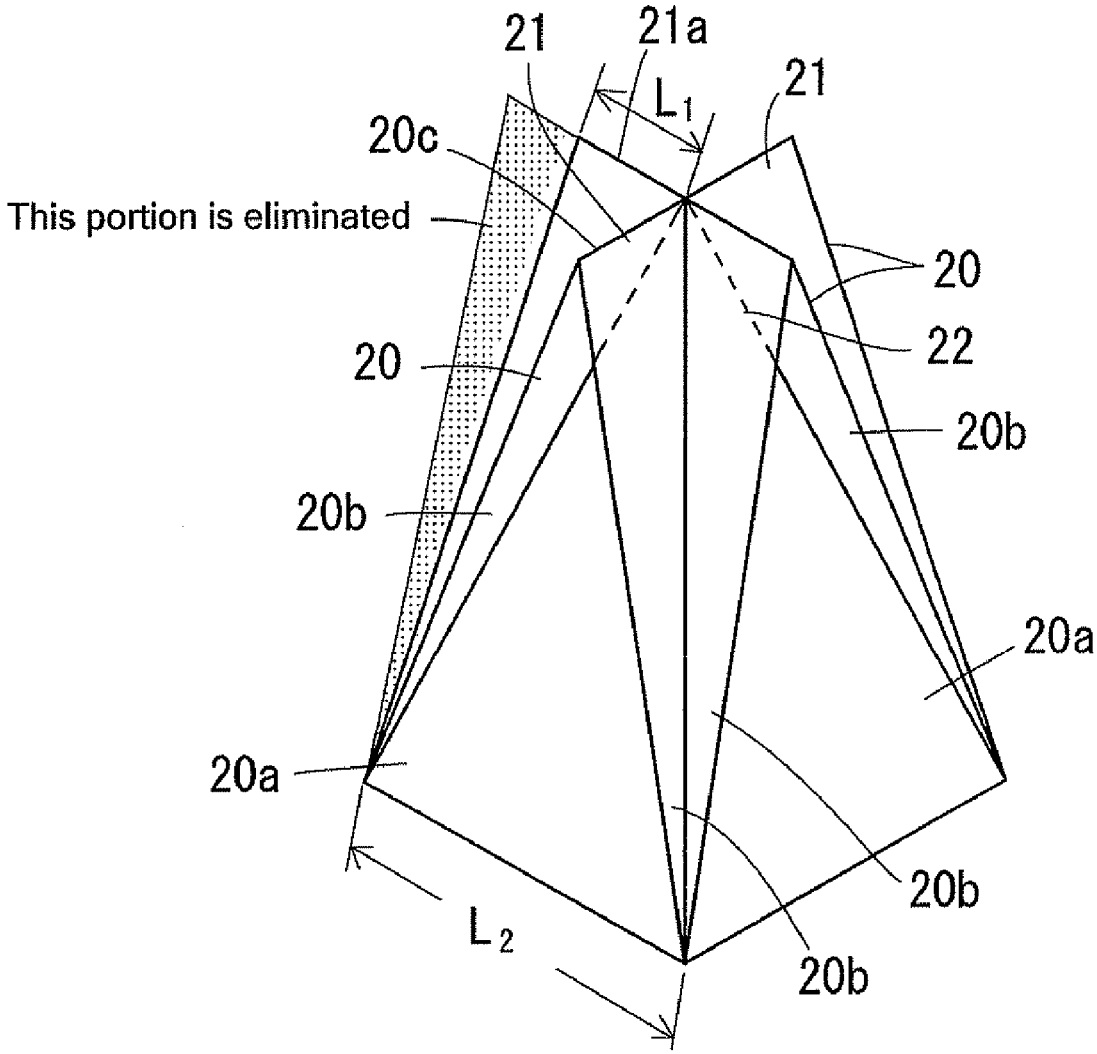
FIG. 13 shows a second embodiment of the present invention and is a perspective view of an electromagnetic wave absorber.

FIG. 13 shows a second embodiment of the electromagnetic wave absorber according to the present invention. Also in this case, a hollow quadrangular pyramid 22 is formed with four triangular surfaces 20*a* each being opposite to the open face of a hollow tetrahedron 20; however, length L, of the ridge 21*a* of the wedge part 21 formed outside the hollow quadrangular pyramid 22 is shortened in comparison with that in the first embodiment described above (an area shaded with dots in the diagram is eliminated). That is, given that length of the base of the hollow quadrangular pyramid 22 is $L_2$, the following relationship is satisfied:

$$2L_1<L_2$$

In addition, other parts of the configuration are same as those in the first embodiment described above, and the same or corresponding portions are represented by the same numbers to thereby omit descriptions.

In the second embodiment, adjusting length $L_1$ of the ridge 21*a* of the wedge part 21 enables the electromagnetic wave absorption characteristics to be finely adjusted.

Figure 14:
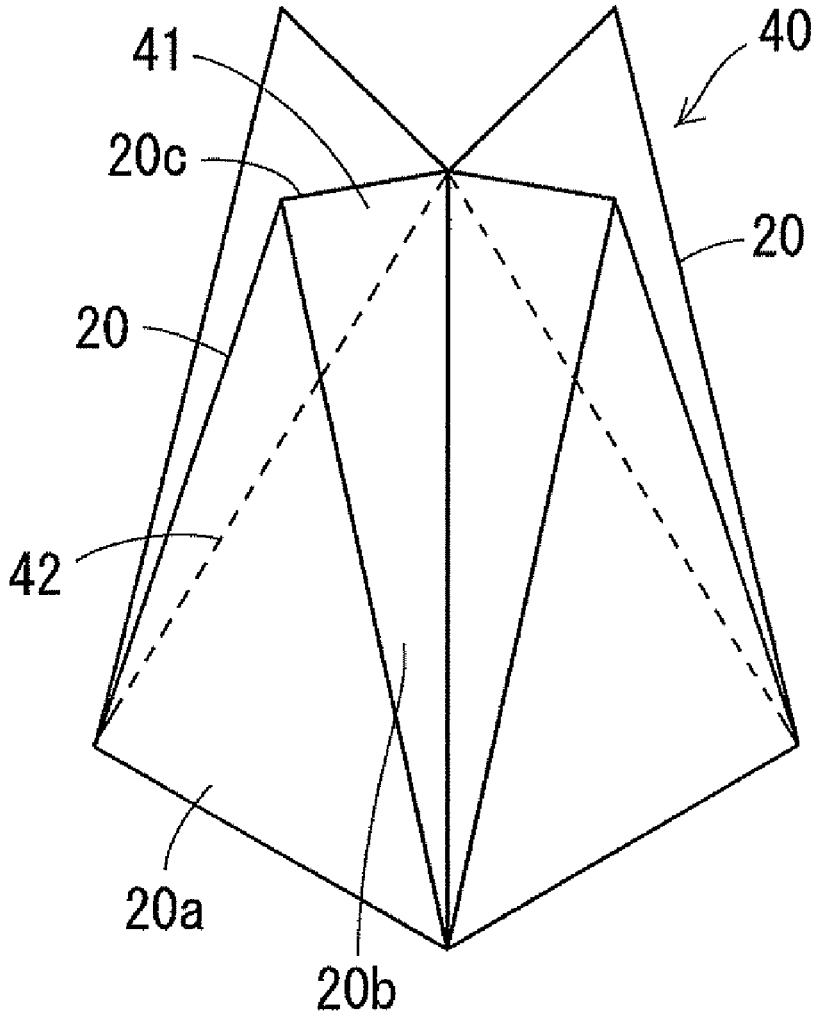
FIG. 14 shows a third embodiment of the present invention and is a perspective view of an electromagnetic wave absorber.
Figure 15A:
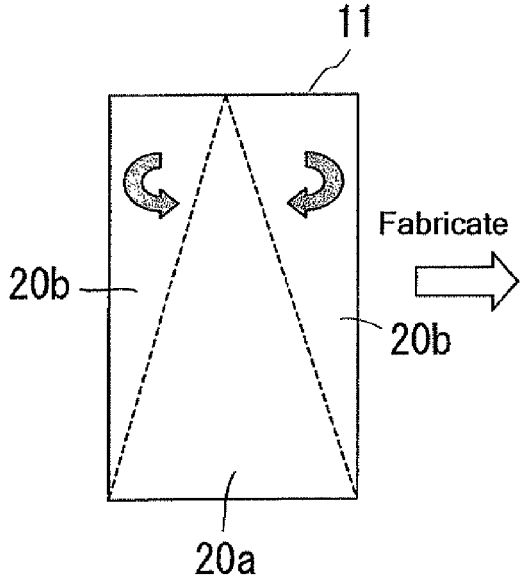
FIGS. 15A, 15B, 15C are explanatory diagrams illustrating a structure and a manufacturing method of an electromagnetic wave absorber shown in the third embodiment.
Figure 15B:
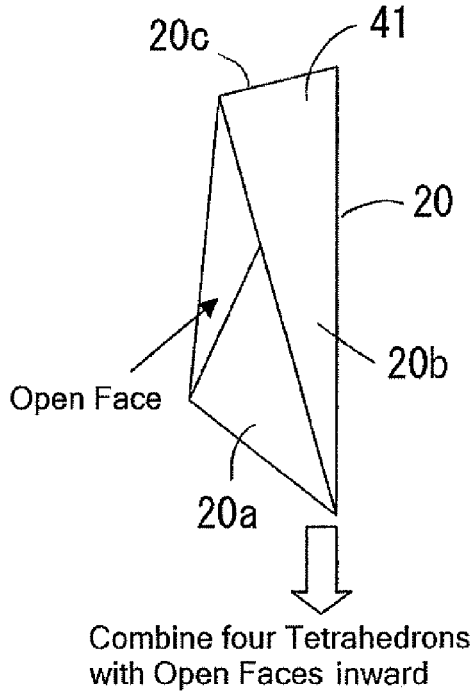
Figure 15C:
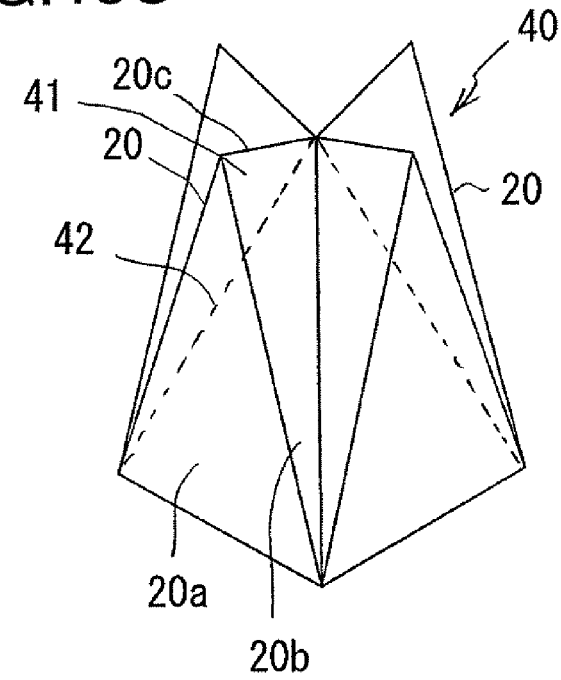
Figure 16:
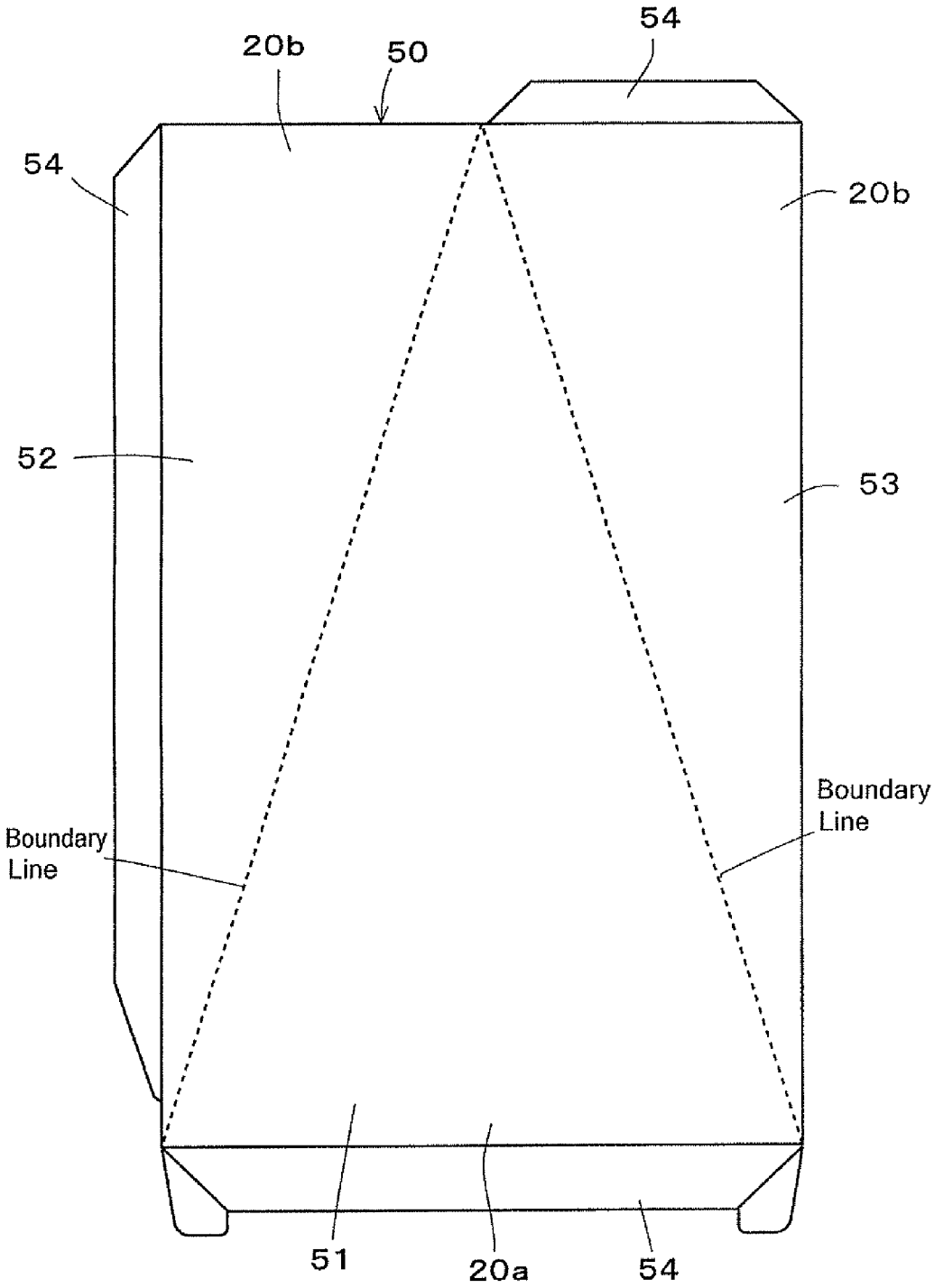
FIG. 16 is a plan view illustrating a shape of a sheet-type electromagnetic wave absorption member used in the manufacturing method of the electromagnetic wave absorber shown in the third embodiment.

A third embodiment illustrating an electromagnetic wave absorber and the manufacturing method thereof according to the present invention is described in reference to FIGS. 14 to 16. FIG. 14 shows an appearance of the electromagnetic wave absorber 40, which has a configuration shown in FIG. 15 C, which is fabricated by folding two places of each quadrangular (including rectangular) sheet-type electromagnetic wave absorption member 11 as shown in FIG. 15A to fabricate four hollow tetrahedrons 20 having one open face as shown in FIG. 15B, and then by connecting and integrating the four hollow tetrahedrons 20 with one another in such a way that each open face of the hollow tetrahedrons 20 defines each side face of a hollow quadrangular pyramid 42. If the open face is in an isosceles triangle shape, the hollow quadrangular pyramid will have a regular quadrangular pyramid shape. The surface opposite to the open face of the hollow tetrahedron 20 is a triangular surface 20*a*, and inverted triangular surfaces 20*b* that are folded and rise with respect to the triangular surface 20*a* are butted and joined to each other at one edge 20*c* to thereby form a wedge part 41. Accordingly, in the state where the four hollow tetrahedrons 20 are combined as shown in FIG. 14 and FIG. 15C, the wedge parts 41 are formed along outer corners (ridge lines) of the hollow quadrangular pyramid 42.

FIG. 16 shows a sheet-type electromagnetic wave absorption member 50 to be used for manufacturing the electromagnetic wave absorber 40 shown in FIG. 14, which is comprised of a first region 51 to be the triangular surface 20*a* opposite to the open face of the hollow tetrahedron 20, second and third regions 52 and 53 to be the two inverted triangular surfaces 20*b* rising with respect to the triangular surface 20*a*, and adhesion margins (overlap widths) 54 for connection.

Then, the sheet-type electromagnetic wave absorption member 50 is folded along respective boundary lines between the regions 51 and 52 and between the regions 51 and 53, to fabricate each hollow tetrahedron 20 by using the adhesion margins 54. The four fabricated hollow tetrahedrons 20 are subsequently connected to and integrated with one another with double-sided adhesive tape, an adhesive, or the like by using adhesion margins 54 in such a way that each open face of the hollow tetrahedrons 20 defines a side face of the hollow quadrangular pyramid 42, to thereby obtain the electromagnetic wave absorber 40 in its completed condition.

The exterior configuration of the electromagnetic wave absorber 40 shown in the third embodiment is also similar to that provided by crossing two wedges, and can obtain electromagnetic absorption characteristics almost similar to those in the case of the first embodiment described above. Other operational effects are also similar to those in the case of the first embodiment described above.

Figure 17:
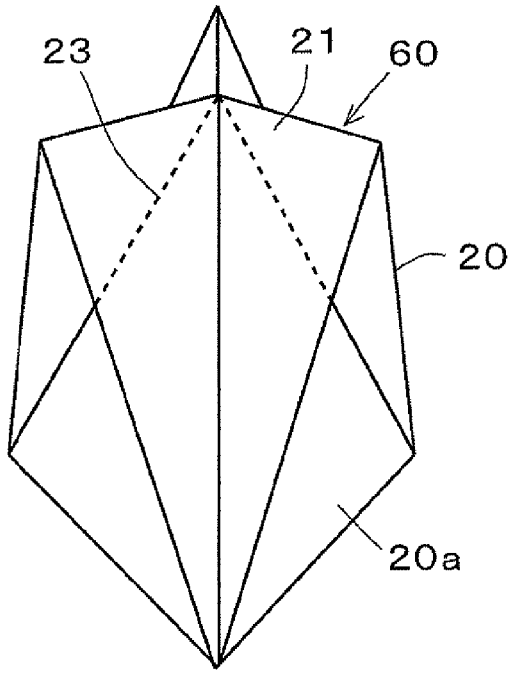
FIG. 17 shows a fourth embodiment of the present invention and is a perspective view of an electromagnetic wave absorber.

FIG. 17 shows a fourth embodiment of an electromagnetic wave absorber according to the present invention, and the electromagnetic wave absorber 60 has a configuration in which three hollow tetrahedrons 20 having one open face are connected to one another in such a way that each triangular surface 20*a* opposite to each open face of the hollow tetrahedrons 20 defines each side face of a hollow triangular pyramid 23 (the open face faces outward).

Figure 18:
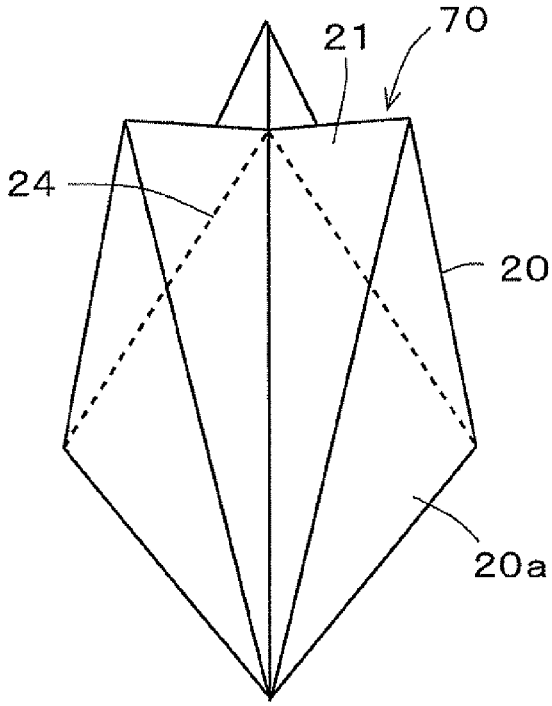
FIG. 18 shows a fifth embodiment of the present invention and is a perspective view of an electromagnetic wave absorber.

FIG. 18 shows a fifth embodiment of an electromagnetic wave absorber according to the present invention, and the electromagnetic wave absorber 70 has a configuration in which three hollow tetrahedrons 20 having one open face are connected to one another in such a way that each open face of the hollow tetrahedrons 20 defines each side face of a hollow triangular pyramid 24 (the open face faces inward, and a triangular surface 20*a* faces outward).

In the case of the fourth or fifth embodiment, wedge parts formed outside the hollow triangular pyramid 23 or 24 face three different directions, causing less difference in characteristics that are caused by the polarization plane of an incoming electromagnetic wave, in comparison with the conventional wedge type electromagnetic wave absorber. Other operational effects are similar to those in the case of First embodiment described above.

In addition, the fourth or fifth embodiment has configurations in each of which three hollow tetrahedrons are combined; however, five or more hollow tetrahedrons may be combined. In other words, an electromagnetic wave absorber having a configuration in which five or more hollow tetrahedrons having one open face are connected to one another in such a way that each surface opposite to each open face of the hollow tetrahedrons defines each side face of a hollow pyramid may be employed, or alternatively an electromagnetic wave absorber having a configuration in which five or more hollow tetrahedrons having one open face are connected to one another in such a way that each open face of the hollow tetrahedrons defines each side face of a hollow pyramid may be employed.

Also, in any of the third to fifth embodiments, length of the ridge of the wedge part formed outside the hollow pyramid may be set to be shorter than a half length of the base of the hollow pyramid as in the case with the second embodiment shown in FIG. 13.

Figure 24A:
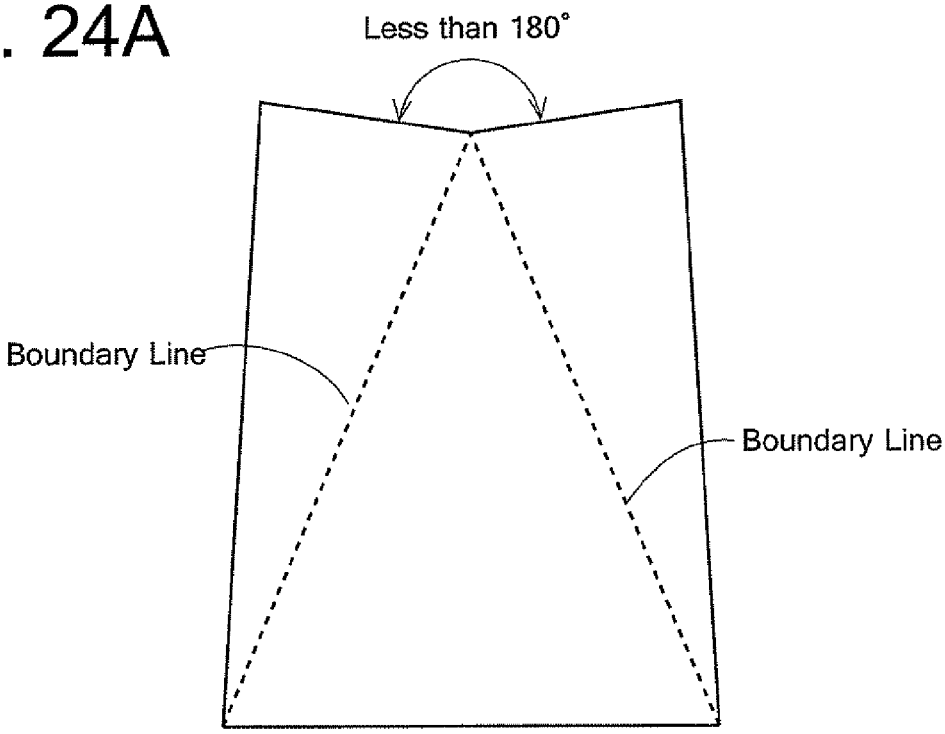
FIG. 24A is a plan view illustrating a example of a sheet-type electromagnetic wave absorption member.
Figure 24B:
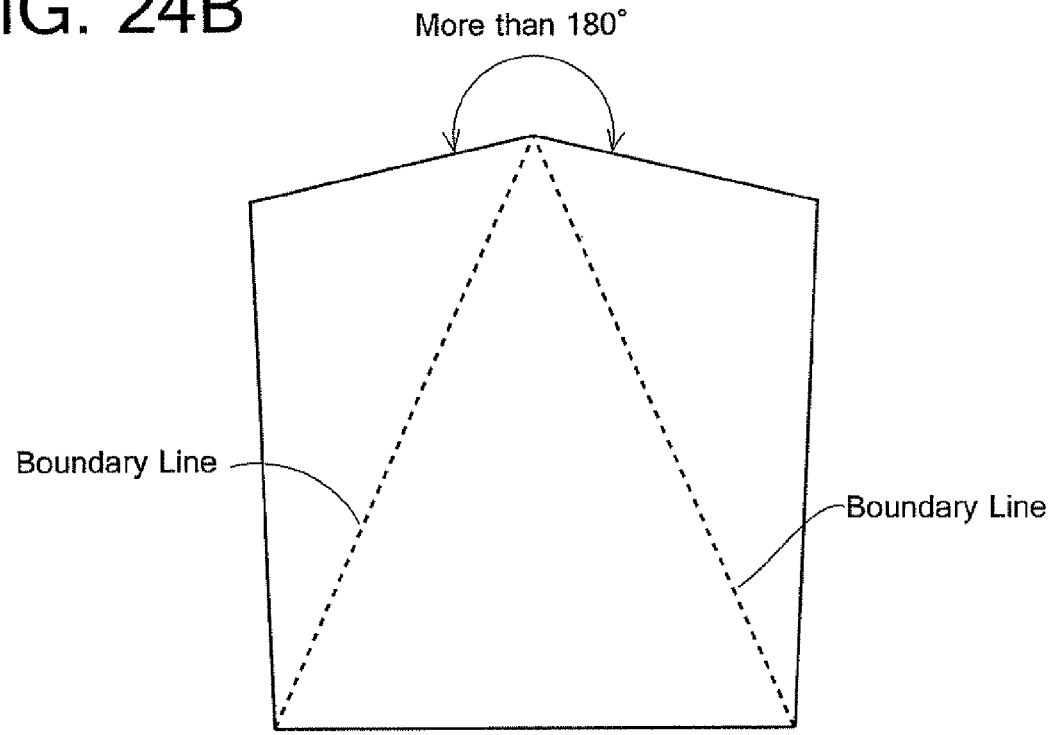
FIG. 24B is a plan view illustrating another example of a sheet-type electromagnetic wave absorption member that can be used for the present invention.

In addition, the sheet-type electromagnetic wave absorption member to fabricate a hollow tetrahedron can be a shape of FIG. 24A or FIG. 24B. FIG. 24A shows a shape such as an isosceles triangle is cut off from an upper side or a base of a symmetrical trapezoid, wherein the upper side or base of the trapezoid is equal to the base of the isosceles triangle. FIG. 24B shows a pentagon shape such as an isosceles triangle is added to an upper side or a base of a symmetrical trapezoid, wherein the upper side or base of the trapezoid is equal to the base of the isosceles triangle.

In other wards, the sheet-type electromagnetic wave absorption member shown in FIG. 24A or FIG. 24B comprises or arranges for taking out a shape of combining a isosceles triangle and two triangles which share the isosceles of the isosceles triangle to be foldable along the isosceles.

The both shapes can fabricate the electromagnetic wave absorption member of the hollow tetrahedron having one open face in case of folding along boundary lines of a region to be a triangular surface.

Referring to the sheet-type electromagnetic wave absorption member mentioned above, adhesion margins, projection portions or slits are provided preferably for connecting each other to fabricate the electromagnetic wave absorber.

Figure 19:
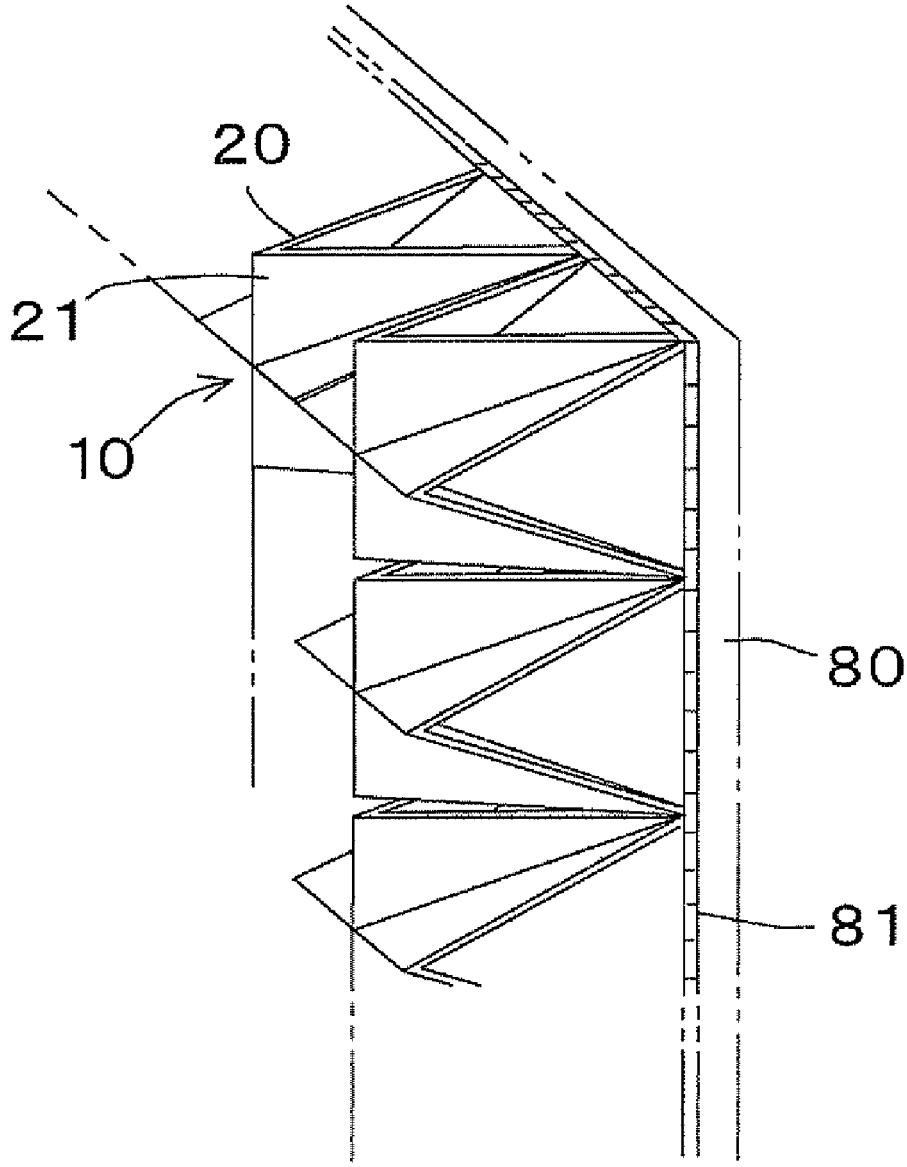
FIG. 19 shows a sixth embodiment of the present invention and is a partial cross-sectional view of an electromagnetic wave anechoic room.
Figure 20:
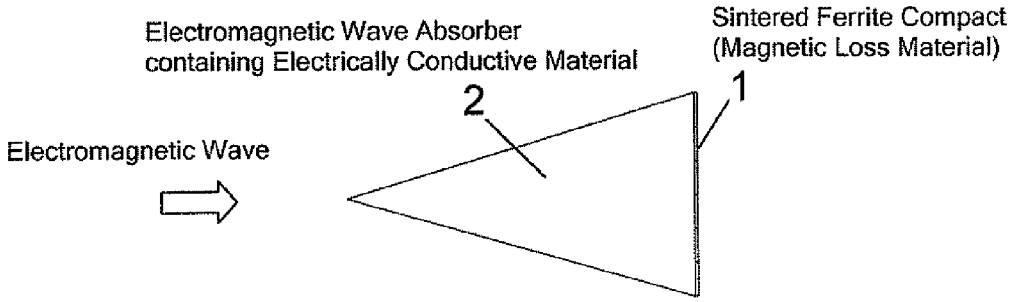
FIG.20 PRIOR ART
FIG. 20 is a side view illustrating a general configuration of a complex electromagnetic wave absorber.
Figure 21A:
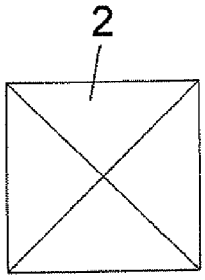
FIG.21A PRIOR ART
FIG. 21A is a front view of a complex electromagnetic wave absorber with a hollow pyramid shape, and FIG. 21B a side view of it.
Figure 21B:
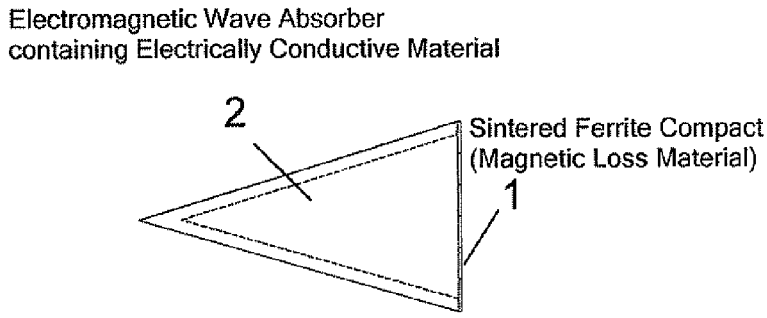
FIG. 21B PRIOR ART
Figure 22A:
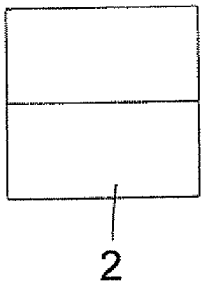
FIG.22A PRIOR ART
FIG. 22A is a front view of a complex electromagnetic wave absorber with a hollow wedge shape, and FIG. 22B a side view of it.
Figure 22B:
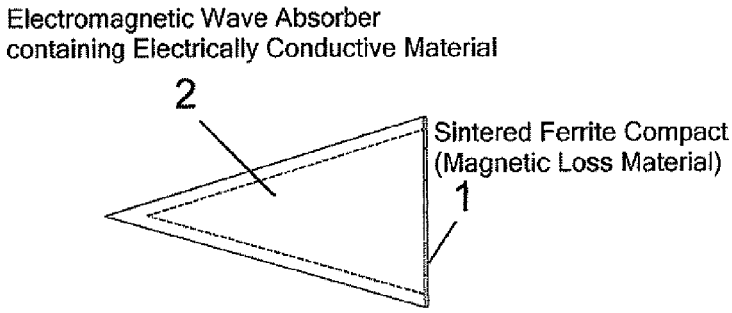
FIG.22B PRIOR ART
Figure 23A:
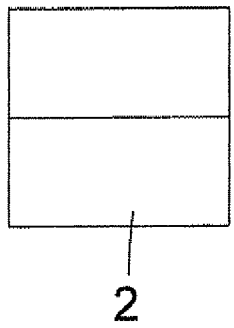
FIG.23A PRIOR ART
FIG. 23A is a front view of a complex electromagnetic wave absorber with a hollow wedge shape having a side open face, and FIG. 23B a side view of it.
Figure 23B:
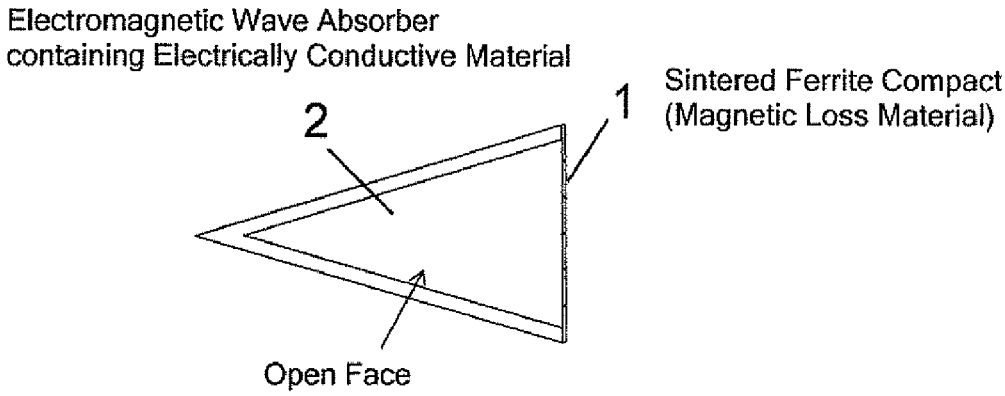
FIG.23B PRIOR ART

FIG. 19 shows a sixth embodiment of the present invention, illustrating an electromagnetic wave anechoic room, which employs the electromagnetic wave absorber 10 described in the first embodiment. In FIG. 19, sintered ferrite compacts (ferrite tiles) 81 are laid on an inner surface of a shielded panel (a panel provided on one or both of its surfaces with conductive plates) 80, and in front of it, numbers of the electromagnetic wave absorbers 10 are arranged adjacently to one another and fixed. Sidewall surfaces and a ceiling plane of the electromagnetic wave anechoic room are normally configured as shown in FIG. 19.

According to the configuration of the electromagnetic wave anechoic room, using the electromagnetic wave absorber 10 shown in the first embodiment enables the construction to be facilitated, excellent electromagnetic wave absorption characteristics to be obtained from low frequency to high frequency and a good electromagnetic wave anechoic room performance to be provided at low cost.

In addition, it should be understood that the electromagnetic wave absorption member having any of the corrugated board structures shown in FIGS. 7 and 8A, 8B, 8C, 8D is applicable to any of the electromagnetic wave absorbers shown in the second to fifth embodiments.

Also, in sixth embodiment illustrating the electromagnetic wave anechoic room, the electromagnetic wave absorber shown in the first embodiment is used; however, the electromagnetic wave absorber shown in any of other embodiments can be used, or an electromagnetic wave absorber having a configuration in which three or more hollow tetrahedrons having one open face are connected to one another in such a way that each surface opposite to each open face of the hollow tetrahedrons defines each side face of a hollow pyramid, or an electromagnetic wave absorber having a configuration in which three or more hollow tetrahedrons having one open face are connected to one another in such a way that each open face of the hollow tetrahedrons defines each side face of a hollow pyramid may be employed.

Although the embodiments of the present invention have been described above, the present invention is not limited thereto and it will be self-evident to those skilled in the art that various modifications and changes may be made without departing from the scope of claims.

As described above, the electromagnetic wave absorber according to the present invention has a configuration in which three or more hollow tetrahedrons having one open face are connected to one another, can be formed by folding sheet-type electromagnetic wave absorption members, and enables transport volume to be reduced by being transported in sheet-type electromagnetic wave absorption members. Also, low-cost electromagnetic wave absorption members with a corrugated board structure can be used to reduce the weight of the electromagnetic wave absorber and increase the structural strength thereof, thus facilitating manufacturing it and installing it to an electromagnetic wave anechoic room or the like.

According to the method for manufacturing an electromagnetic wave absorber of the present invention, the electromagnetic wave absorber can be assembled by folding sheet-type electromagnetic wave absorption members and connecting them to one another with double-sided adhesive tape, an adhesive, or the like. Special tools or parts are not required for the assembling, thus facilitating installing the electromagnetic wave absorber to an electromagnetic wave anechoic room or the like.

The exterior configuration of an electromagnetic wave absorber according to the present invention corresponds to that provided with wedge parts at the outer side of a pyramid and can obtain excellent electromagnetic wave absorption characteristics from low frequency to high frequency in comparison with a pyramidal type, and since the three or more wedge parts are provided along corners (ridge lines) of the pyramid, there is no or small difference in characteristics caused by a polarization plane.

An electromagnetic wave anechoic room according to the present invention can be easily constructed at low cost and excellent in electromagnetic wave absorption characteristics by using the above-described electromagnetic wave absorber.

What is claimed is:

1. An electromagnetic wave absorber comprising at least three hollow tetrahedrons, each tetrahedron having a first triangular surface including an electrically conducting material, and a pair of second triangular surfaces, including an electrically conducting material, the pair of second triangular surfaces defining between them an open face of the tetrahedron opposite the first triangular surface, the tetrahedrons being connected to one another at edges of the first triangular surfaces so that each first triangular surface defines a respective side face of a hollow pyramid and the pair of second triangular surfaces of each of the tetrahedrons forms a wedge part extending from and outside the hollow pyramid.

2. The electromagnetic wave absorber according to claim 1, wherein the hollow pyramid has a polygonal base with edges having a length and each of the wedge parts extending from and outside the hollow pyramid has a ridge length that is shorter than one half of the length of the edges of the base of the hollow pyramid.

3. The electromagnetic wave absorber according to claim 1, comprising four of the hollow tetrahedrons connected to one another.

4. The electromagnetic wave absorber according to claim 1, wherein each of the hollow tetrahedrons is made of a sheet electromagnetic wave absorption member.

5. The electromagnetic wave absorber according to claim 4, wherein the sheet electromagnetic wave absorption members have a corrugated board structure having at least one sheet including an electrically conductive material.

6. The electromagnetic wave absorber according to claim 4, wherein a base material of the sheet electromagnetic wave absorption members is flame resistant or nonflammable.

7. The electromagnetic wave absorber according to claim 1, including sintered ferrite compacts on the base of the hollow pyramid.

8. An electromagnetic wave absorber comprising at least three hollow tetrahedrons, each tetrahedron having a first triangular surface including an electrically conducting material and a pair of second triangular surfaces, including an electrically conducting material, the pair of second triangular surfaces defining between them an open face opposite the first triangular surface of the tetrahedron, the tetrahedrons being connected to one another so that each open face defines a respective side face of a hollow pyramidal shape and the pair of second triangular surfaces of each of the tetrahedrons forms a wedge part extending from and outside the hollow pyramidal shape.

9. The electromagnetic wave absorber according to claim 8, wherein the hollow pyramidal shape has a polygonal base with edges having a length and each of the wedge parts extending from and outside the hollow pyramidal shape has a ridge length that is shorter than one half of the length of the edges of the base of the hollow pyramidal shape.

10. The electromagnetic wave absorber according to claim 8, comprising four of the hollow tetrahedrons connected to one another.

11. The electromagnetic wave absorber according to claim 8, wherein each of the hollow tetrahedrons is made of a sheet electromagnetic wave absorption member.

12. The electromagnetic wave absorber according to claim 11, wherein the sheet electromagnetic wave absorption members have a corrugated board structure having at least one sheet including an electrically conductive material.

13. The electromagnetic wave absorber according to claim 11, wherein a base material of the sheet electromagnetic wave absorption members is flame resistant or nonflammable.

14. The electromagnetic wave absorber according to claim 8, including sintered ferrite compacts on the base of the hollow pyramidal shape.

15. A method of manufacturing an electromagnetic wave absorber, the method comprising:

folding at least three sheet electromagnetic wave absorption members at each of two places to fabricate, from the at least three members, at least three hollow tetrahedrons, each tetrahedron having three surfaces and one open face opposite one of the surfaces; and connecting the hollow tetrahedrons to one another so that each surface of each tetrahedron that is opposite an open face of each tetrahedron defines a respective side face of a hollow pyramid and a pair of surfaces of each tetrahedron forms a respective wedge part extending from and outside the hollow pyramid.

16. A method of manufacturing an electromagnetic wave absorber comprising:

employing (i) a first sheet electromagnetic wave absorption member defining a first triangular region and a second triangular region that is inverted with respect to the first triangular region and that is adjacent the first triangular region, and (ii) a second sheet electromagnetic wave absorption member defining an inverted triangular surface increasing in width with respect to the first triangular region, joining the second sheet electromagnetic wave absorption member to the first sheet electromagnetic wave absorption member, where the first and second triangular regions adjoin, to form a component of an electromagnetic wave absorber;

forming at least three of the components of the electromagnetic wave absorber; and connecting each of the at least three components of the electromagnetic wave absorber to two other components by joining an edge of each of the first sheet electromagnetic wave absorption members to another first sheet electromagnetic wave absorption member where the first and second triangular regions adjoin and on an opposite side of the first sheet electromagnetic wave absorption member to which the second sheet electromagnetic wave absorption member is joined.

17. A method of manufacturing an electromagnetic wave absorber, the method comprising:

folding each of a plurality of sheet electromagnetic wave absorption members at each of two places to fabricate at least three hollow tetrahedrons, each tetrahedron having three surfaces and one open face; and connecting the hollow tetrahedrons to one another so that each open face of each of the hollow tetrahedrons defines limits of a respective side face of a hollow pyramidal shape and a pair of surfaces of each tetrahedron forms a respective wedge part extending from and outside the hollow pyramidal shape.

18. An electromagnetic wave anechoic room wherein the electromagnetic wave absorbers according to claim 1 are disposed on at least one of inner surfaces of sidewalls and a ceiling plane of the anechoic room.

19. An electromagnetic wave anechoic room wherein the electromagnetic wave absorbers according to claim 8 are disposed on at least one of inner surfaces of sidewalls and a ceiling plane of the anechoic room.

20. The electromagnetic wave absorber according to claim 1, wherein each hollow tetrahedron is formed from a sheet electromagnetic wave absorption member having a shape for fabricating the hollow tetrahedron, when folded along boundary lines of a region to produce the first triangular surface.

21. The electromagnetic wave absorber according to claim 1, wherein each of the hollow tetrahedrons is formed from a sheet electromagnetic wave absorption member, comprising an isosceles triangle as the first triangular surface and two triangles which adjoin the equal length sides of the isosceles triangle and are foldable along the equal length sides of the isosceles triangle to form the pair of second triangular surfaces.

22. The electromagnetic wave absorber according to claim 21 wherein the sheet electromagnetic wave absorption member includes at least one of adhesion margins, projecting portions, and slits for connection to another sheet electromagnetic wave absorption member.

23. The electromagnetic wave absorber according to claim 1, wherein each of the hollow tetrahedrons includes a sheet electromagnetic wave absorption member comprising one of a quadrangular shape, a symmetrical trapezoid from which an isosceles triangle is removed from an upper side or a base of the symmetrical trapezoid, wherein the upper side or base of the trapezoid is equal in length to the base of the isosceles triangle, and an isosceles triangle added to an upper side or a base of a symmetrical trapezoid, wherein the upper side or base of the trapezoid is equal in length to the base of the isosceles triangle, so that the hollow tetrahedron having one open face can be folded from the shape along boundary lines of the first triangular surface.

24. The electromagnetic wave absorber according to claim 8, wherein each hollow tetrahedron is formed from a sheet electromagnetic wave absorption member having a shape for fabricating the hollow tetrahedron, when folded along boundary lines of a region to produce the first triangular surface.

25. The electromagnetic wave absorber according to claim 8, wherein each of the hollow tetrahedrons includes a sheet electromagnetic wave absorption member comprising or arranging one of a quadrangular shape, a symmetrical trapezoid from which an isosceles triangle is removed from an upper side or a base of the symmetrical trapezoid, wherein the upper side or base of the trapezoid is equal in length to the base of the isosceles triangle, and an isosceles triangle added to an upper side or a base of a symmetrical trapezoid, wherein the upper side or base of the trapezoid is equal in length to the base of the isosceles triangle, so that the hollow tetrahedron having one open face can be folded from the shape along boundary lines of the first triangular surface.

* * * * *